US007591520B2

(12) United States Patent
Iwao

(10) Patent No.: US 7,591,520 B2
(45) Date of Patent: Sep. 22, 2009

(54) INK JET PRINTER AND METHOD FOR DETERMINING PULSE WIDTH

(75) Inventor: Naoto Iwao, Nagoya (JP)

(73) Assignee: Brother Kogyo Kabushiki Kaisha (JP)

( * ) Notice: Subject to any disclaimer, the term of this patent is extended or adjusted under 35 U.S.C. 154(b) by 232 days.

(21) Appl. No.: 11/288,083

(22) Filed: Nov. 29, 2005

(65) Prior Publication Data

US 2006/0114279 A1 Jun. 1, 2006

(30) Foreign Application Priority Data

Nov. 30, 2004 (JP) ..... 2004-346525

(51) Int. Cl.
*B41J 29/38* (2006.01)

(52) U.S. Cl. ..... 347/11; 347/10; 347/180

(58) Field of Classification Search ..... 347/5, 347/9–12, 16, 19, 14, 180, 194; 400/120.01
See application file for complete search history.

(56) References Cited

U.S. PATENT DOCUMENTS

| | | | | |
|---|---|---|---|---|
| 5,339,099 | A * | 8/1994 | Nureki et al. | 347/180 |
| 5,610,637 | A * | 3/1997 | Sekiya et al. | 347/10 |
| 6,276,772 | B1 * | 8/2001 | Sakata et al. | 347/10 |
| 6,523,923 | B2 * | 2/2003 | Sekiguchi | 347/11 |
| 6,808,254 | B2 | 10/2004 | Sakaida et al. | |
| 2002/0036669 | A1 | 3/2002 | Hosono et al. | |
| 2003/0002899 | A1 * | 1/2003 | Furukawa et al. | 400/120.01 |
| 2003/0103118 | A1 | 6/2003 | Watanabe et al. | |
| 2003/0122902 | A1 | 7/2003 | Sakaida et al. | |
| 2003/0156164 | A1 | 8/2003 | Sakaida et al. | |
| 2004/0041885 | A1 | 3/2004 | Hirota | |
| 2004/0090498 | A1 | 5/2004 | Sakaida et al. | |
| 2005/0231554 | A1 | 10/2005 | Sakaida et al. | |

FOREIGN PATENT DOCUMENTS

| | | |
|---|---|---|
| EP | 0 893 258 | 1/1999 |
| EP | 0 916 495 | 5/1999 |
| EP | 1 078 750 | 2/2001 |
| EP | 1 093 918 | 4/2001 |
| JP | 2003-305852 | 10/2003 |

OTHER PUBLICATIONS

EP 05 025 998.5-1251—Communication Pursuant to Article 94(3) EPC, dated Feb. 14, 2008 (Cited D1 document is EP-A-0916495).
European Patent Application 05025998.5, Communication Pursuant To Article 94(3) EPC, Mailed May 8, 2009.

* cited by examiner

*Primary Examiner*—Lam S Nguyen
(74) *Attorney, Agent, or Firm*—Banner & Witcoff, Ltd.

(57) ABSTRACT

An ink jet printer has an ink jet head comprising a nozzle that discharges an ink droplet toward a print medium, and an actuator that makes the nozzle discharge the ink droplet when a pulse signal is applied to the actuator. An applying device can apply at least two kinds of pulse signals to the actuator. The pulse width of each kind of pulse signal mutually differs. A first storage stores at least two kinds of base pulse widths. Each kind of base pulse width mutually differs and corresponds with a different kind of pulse signal. An inputting device inputs a predetermined value which is stored in the second storage. The applying device determines a pulse width of each kind of pulse signal by multiplying the corresponding base pulse width stored in the first storage by the predetermined value stored in the second storage.

14 Claims, 12 Drawing Sheets

204

| Actuator Unit | Coefficient |
|---|---|
| 21a(2a) | α 1 |
| 21b(2a) | α 2 |
| 21c(2a) | α 3 |
| 21d(2a) | α 4 |
| 21a(2b) | α 5 |
| | |
| 21d(2d) | α 16 |

INK JET PRINTER AND METHOD FOR DETERMINING PULSE WIDTH

CROSS-REFERENCE TO RELATED APPLICATION

This application claims priority to Japanese Patent Application No. 2004-346525, filed on Nov. 30, 2004, the contents of which are hereby incorporated by reference into the present application.

BACKGROUND OF THE INVENTION

1. Field of the Invention

The present invention relates to an ink jet printer that applies pulse signals to an actuator of an ink jet head. The present invention further relates to a method for determining pulse width of the pulse signals applied to the actuator of the ink jet head. The ink jet printer of the present invention includes all devices for printing words, images, etc. by discharging ink towards a print medium. For example, the ink jet printer of the present invention includes copying machines, fax machines, multifunctional products, etc.

2. Description of the Related Art

An ink jet printer has an ink jet head. Usually, the ink jet head has a plurality of units, each unit having a nozzle for discharging ink toward a print medium, a pressure chamber communicating with the nozzle, and an actuator facing the pressure chamber. As one example, a piezoelectric element is used as the actuator.

A pulse signal that has at least two levels (high voltage and low voltage) is applied to the piezoelectric element. For example, a pulse signal having a high voltage, this being a base voltage, is applied. The piezoelectric element to which the pulse signal is applied changes voltage in the sequence: high voltage, low voltage, high voltage. When the piezoelectric element changes from high voltage to low voltage, the piezoelectric element deforms away from the pressure chamber. The capacity of the pressure chamber thus increases, and ink is drawn into the pressure chamber. When the piezoelectric element changes from low voltage to high voltage, the piezoelectric element deforms towards the pressure chamber. The capacity of the pressure chamber thus decreases, and pressure of the ink within the pressure chamber is increased. The pressurized ink is discharged from the nozzle. Usually, one ink droplet is discharged from the nozzle when one pulse signal is applied to the piezoelectric element.

When one ink droplet is discharged, one dot is formed on the print medium. There are ink jet printers that form one dot on the print medium by continuously discharging a plurality of ink droplets. Pulse signals are applied continuously to the piezoelectric element to continuously discharge a plurality of ink droplets. For example, two ink droplets may be discharged from the nozzle by applying two continuous pulse signals to the piezoelectric element. Usually, the ink droplet which is discharged later has a greater discharge speed than the ink droplet which is discharged first. As a result, the two ink droplets merge before reaching the print medium, and form one ink droplet. When this merged one ink droplet adheres to the print medium, one dot is formed. In this case, the size of the dot is larger than the dot formed from only one ink droplet. As another example, three ink droplets may be discharged from the nozzle by applying three continuous pulse signals to the piezoelectric element. The three ink droplets merge to form one ink droplet. When this merged one ink droplet adheres to the print medium, one dot is formed. In this case, the size of the dot is larger than the dot formed from two ink droplets.

In the present specification, a point formed on a print medium by discharging only one ink droplet from a nozzle is termed a dot. Furthermore, a point formed on a print medium by discharging a plurality of ink droplets onto the same location on the print medium from one or a plurality of nozzles is also termed a dot.

In the present specification, forming one dot from only one ink droplet is termed single discharging. Forming one dot from two ink droplets is termed double discharging, and forming one dot from three ink droplets is termed triple discharging.

The size of the dots can be changed by changing the number of ink droplets used to form one dot. There are ink jet printers which change the size of the dots according to a print mode.

Even if the same pulse signals is applied to actuators (for example, piezoelectric elements) that have been manufactured using the same manufacturing process, the ink droplets are not necessarily discharged at the same speed. For example, if the same pulse signals are applied to the piezoelectric element of one ink jet printer and to the piezoelectric elements of another ink jet printer, there may be a difference in the discharge speed of the ink droplets of the former ink jet printer and of the latter ink jet printer.

If there is a difference in the discharge speed of the ink droplets between ink jet printers, identical printing results cannot be achieved. A technique for mass-producing ink jet printers that can obtain satisfactory printing results is sought.

BRIEF SUMMARY OF THE INVENTION

Discharge speed of an ink droplet cannot be known before an ink jet printer is manufactured by assembling each component part. Further, it is known that the discharge speed of the ink droplet varies if the pulse width of the pulse signal applied to the actuator varies. If these issues are taken into account, the mass-production of ink jet printers which can obtain satisfactory printing results is possible by doing the following against each of the ink jet printers.

(1) Ink is actually discharged from the ink jet printer, this discharge is observed, and a pulse width of the pulse signal that will obtain satisfactory printing results is determined.

The present inventors discovered from their research that the pulse width of pulse signal that can obtain satisfactory printing results may mutually differ in the case of single discharging, double discharging, and triple discharging.

Further, the present inventors observed that when one dot was formed utilizing a plurality of continuous pulse signals (for example, double discharging or triple discharging), the manner in which the pulse width of each pulse signal differs may obtain satisfactory printing results. For example, in the case of double discharging, the manner in which the pulse width of the first pulse signal differs from the pulse width of the second pulse signal may obtain satisfactory printing results. Further, in the case of triple discharging, the manner in which the pulse width of the first pulse signal, the pulse width of the second pulse signal, and the pulse width of the third pulse signal mutually differs may obtain satisfactory printing results.

Consequently, when a plurality of kinds of pulse signals is utilized, it is preferred that the pulse width of the pulse signals is determined for each kind of pulse signal based on the results of the actual discharge of ink. For example, it is preferred that the pulse width of the pulse signals is determined for each case: the pulse width of single discharging; the first pulse width and the second pulse width of double discharging; and the first pulse width, the second pulse width, and the third pulse width of triple discharging.

(2) When the pulse width of each kind of pulse signal is determined, the ink jet printer is set to execute printing by utilizing each determined pulse width.

If each ink jet printer is manufactured as described above, various kinds of pulse signals that can obtain satisfactory printing results are applied to the actuator. As a result, ink jet printers that can obtain satisfactory printing results may be manufactured.

If a plurality of kinds of pulse signals is utilized, as described above, a plurality of kinds of pulse widths (there are six kinds of pulse widths in the above example) may be obtained. In this case, after the plurality of kinds of pulse widths have been obtained, these must all be input into the ink jet printer, and consequently the inputting operation takes time. The present embodiment teaches a technique for reducing the time required for this inputting operation.

The present inventors observed that the pulse widths of the pulse signals utilized by the ink jet printer may be determined by a combination of a base pulse width and a predetermined value. For example, if a base pulse width 't' is multiplied by a predetermined value $\alpha$, a pulse width ($t \times \alpha$) of a pulse signal may be determined. For example, if a pulse width that can obtain satisfactory printing results is T, the predetermined value a can be determined by dividing T by t.

In the case where a plurality of kinds of pulse signals having differing pulse widths is applied to the actuator, the base pulse width may be determined for each of the pulse signals. For example, the base pulse width for the pulse signal for single discharging might be determined as t1, the base pulse width for the first pulse signal for double discharging might be determined as t2, and the base pulse width for the second pulse signal for double discharging might be determined as t3. t1, t2, and t2 may be mutually differing values.

The present inventors observed that, if each base pulse width for the different kinds of pulse signals is determined in advance, each pulse width for the different kinds of pulse signals may be determined merely by multiplying the base pulse width by one predetermined value. A pulse width T for the pulse signal of single discharging is obtained. This pulse width T can obtain satisfactory printing results. When the obtained pulse width T is divided by the base pulse width t1, $\alpha$1 is obtained. When $\alpha$1 is multiplied by the base pulse width t1, the pulse width for single discharging may be obtained. Further, when $\alpha$1 is multiplied by the base pulse width t2, the pulse width of the first signal for double discharging may be obtained. When $\alpha$1 is multiplied by the base pulse width t3, the pulse width of the second signal for double discharging may be obtained. The present inventors observed that satisfactory printing results may be achieved by utilizing two pulse widths obtained for double discharging in this manner. That is, when satisfactory printing results can be achieved from a pulse width obtained by multiplying the first kind of base pulse width by the predetermined value, satisfactory printing results may also be achieved from a pulse width obtained by multiplying the second kind of base pulse width by the same value.

An ink jet printer taught in the present specification comprises a device for storing base pulse widths corresponding to various kinds of pulse signals. Further, the ink jet printer comprises an inputting device for inputting the predetermined value. For example, a manufacturer or user of the ink jet printer may input the predetermined value to the inputting device. This inputting device includes an interface connected to an external device. For example, the manufacturer or the user may input the predetermined value to the external device. In this case, the predetermined value that has been input to the external device is input to the interface of the ink jet printer.

A device for applying the pulse signals to the actuator determines pulse widths of the various kinds of pulse signals by multiplying each kind of base pulse width by the predetermined value.

With this ink jet printer, the various pulse widths of the plurality of kinds of pulse signals are set by the manufacturer or the user merely inputting the predetermined value. When this ink jet printer is utilized, the time required for the inputting operation may be made shorter.

The above description is merely an example, and the scope of the present invention is not restricted based on the above description. The scope of the present invention is determined on the basis of the claims.

BRIEF DESCRIPTION OF THE DRAWINGS

In FIG. 3, pressure chambers, apertures, and nozzles are shown by solid lines.

FIG. 6(A) shows a state of the piezoelectric element when a high voltage has been applied. FIG. 6(B) shows a state of the piezoelectric element when a low voltage has been applied. FIG. 6(C) shows a state of the piezoelectric element when a high voltage has again been applied.

DETAILED DESCRIPTION OF THE INVENTION

Figure 1:
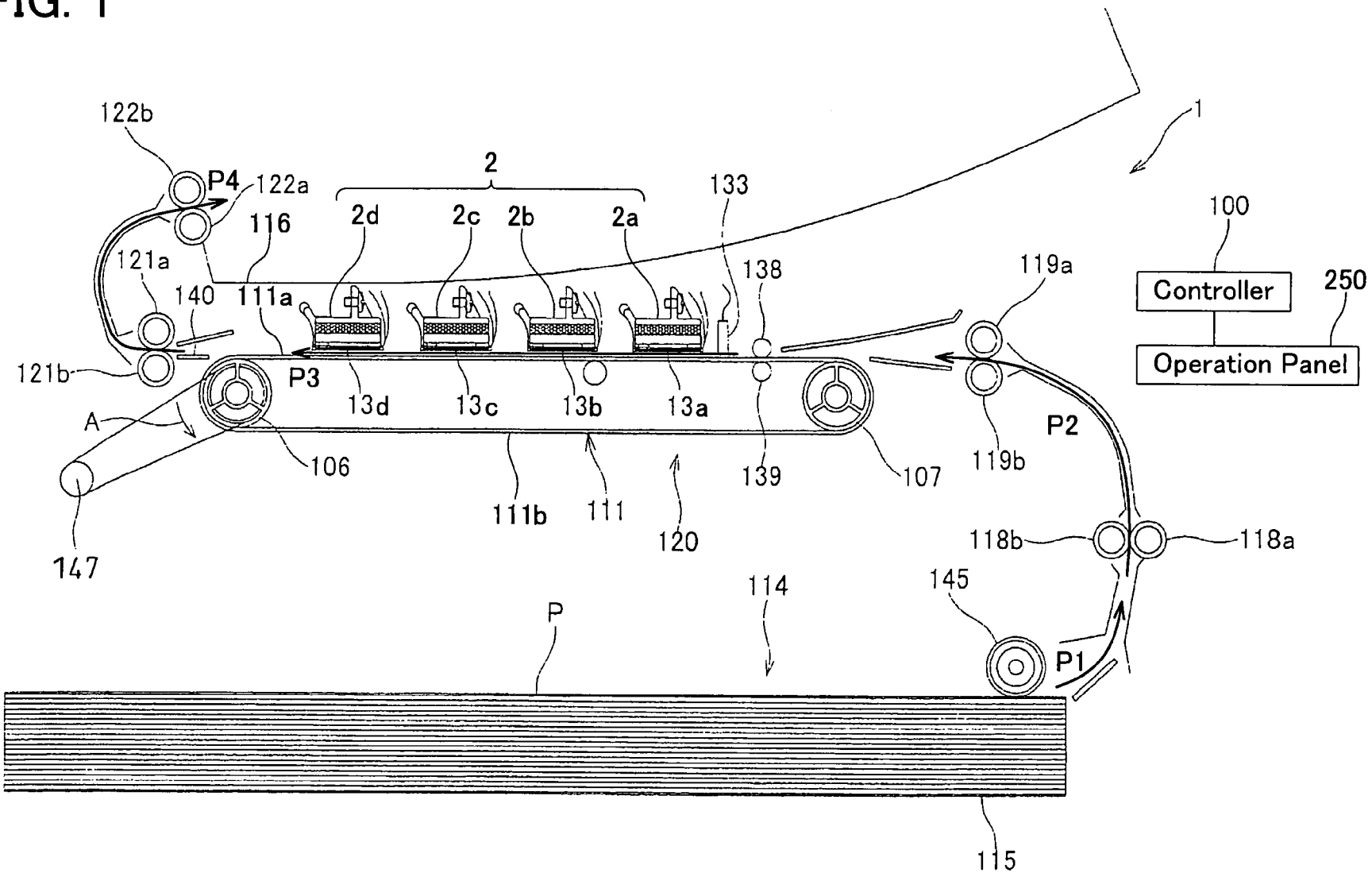
FIG. 1 shows a schematic block diagram of an ink jet printer.

An applying device may apply a pulse signal for single discharging to an actuator within a predetermined period. In this case, the actuator makes a nozzle discharge one ink droplet to form one dot on a print medium when the pulse signal is applied to the actuator within the predetermined period.

In this case, a first storage may store a base pulse width for single discharging and a base pulse width of other pulse signal. The applying device may determine the pulse width of the pulse signal for single discharging by multiplying the base pulse width for single discharging by a predetermined value. Further, the applying device may determine the pulse width of the other pulse signal by multiplying other base pulse width by the predetermined value.

The ink jet printer may determine the pulse width for single discharging by utilizing the base pulse width and the predetermined value.

The applying device may apply a second pulse signal and a third pulse signal to the actuator within the predetermined period so as to perform double discharging. In this case, the actuator makes the nozzle discharge two ink droplets to form one dot on the print medium when the two pulse signals are applied to the actuator within the predetermined period.

The ink jet printer is capable of determining a second pulse width and a third pulse width for double discharging by utilizing the respective base pulse widths and the predetermined value.

The first storage may store a base pulse width corresponding with the second pulse signal, a base pulse width corresponding with the third pulse signal, and a first base period between these two pulse signals. In this case, the applying device may determine a period between the two pulse signals by multiplying the first base period stored in the first storage by the predetermined value stored in the second storage.

When this is done, the period between the second pulse signal and the third pulse signal for double discharging may be determined by utilizing the base period and the predetermined value.

The applying device may apply a fourth pulse signal, a fifth pulse signal and a sixth pulse signal to the actuator within the predetermined period so as to perform triple discharging. In this case, the actuator makes the nozzle discharge three ink droplets to form one dot on the print medium when the three pulse signals are applied to the actuator within the predetermined period.

The ink jet printer is capable of determining a fourth pulse width, a fifth pulse width and a sixth pulse width for performing triple discharging by utilizing the respective base pulse widths and the predetermined value.

The first storage may store a base pulse width corresponding with the fourth pulse signal, a base pulse width corresponding with the fifth pulse signal, a base pulse width corresponding with the sixth pulse signal, a second base period between the fourth pulse signal and the fifth pulse signal, and a third base period between the fifth pulse signal and the sixth pulse signal. In this case, the applying device may determine a period between the fourth pulse signal and the fifth pulse signal by multiplying the second base period stored in the first storage by the predetermined value stored in the second storage. Further, the applying device may determine a period between the fifth pulse signal and the sixth pulse signal by multiplying the third base period stored in the first storage by the predetermined value stored in the second storage.

The ink jet head may further comprise a pressure chamber communicating with the nozzle. The actuator may be a piezoelectric element facing the pressure chamber.

The ink jet head may comprise a plurality of units. Each unit may comprise the nozzle, the pressure chamber, and the piezoelectric element. The piezoelectric elements may be divided into a plurality of element groups (these may be termed actuator units). Each element group may comprise a common electrode, a plurality of individual electrodes, and a piezoelectric layer disposed between the common electrode and the individual electrodes. An inputting device may input the predetermined value for each element group. The second storage may store a plurality of combinations of the predetermined value and the element group. The applying device may determine the pulse width of each kind of pulse signal for each element group by multiplying the corresponding base pulse width stored in the first storage by the predetermined value combined with the element group in the second storage.

With this configuration, the pulse width of each kind of pulse signal may be set in units of the actuator units. This ink jet printer functions effectively in the case where each actuator unit has a different ink discharging performance when the same pulse signal is applied thereto.

Each of the piezoelectric elements may have a different ink discharging performance when the same pulse signal is applied thereto. In this case, the following technique is effective. The inputting device may input the predetermined value for each piezoelectric element. The second storage may store a plurality of combinations of the predetermined value and the piezoelectric element. The applying device determines the pulse width of each kind of pulse signal for each piezoelectric element by multiplying the corresponding base pulse width stored in the first storage by the predetermined value combined with the piezoelectric element in the second storage.

When this is done, the pulse width of each kind of pulse signal may be set in units of the piezoelectric elements.

If the ink jet printer comprises a plurality of inkjet heads, each of the ink jet heads may have a different ink discharging performance when the same pulse signal is applied thereto. In this case, the following technique is effective. The inputting device may input the predetermined value for each ink jet head. The second storage may store a plurality of combinations of the predetermined value and the ink jet head. The applying device may determine the pulse width of each kind of pulse signal for each ink jet head by multiplying the corresponding base pulse width stored in the first storage by the predetermined value combined with the ink jet head in the second storage.

When this is done, the pulse width of each kind of pulse signal may be set in units of the ink jet heads.

In the ink jet printer that is utilizing single discharging, the predetermined value that is input by the inputting device may be determined as follows. This method may perform a step of specifying a pulse width of a pulse signal which is capable of obtaining the largest ink droplet discharging speed when the pulse signal is applied to the actuator within the predetermined period. This method may perform a step of dividing the pulse signal specified in the above step by the base pulse width that corresponds with the pulse signal for single discharging. When this is done, the predetermined value may be obtained.

The following method is also useful. This method is a method of determining the pulse widths of at least two kinds of pulse signals which are to be applied to an actuator of an ink jet head. The ink jet head comprises a nozzle that discharges an ink droplet toward a print medium, and the actuator that makes the nozzle discharge the ink droplet when the pulse signal is applied to the actuator. The method comprises a step of determining at least two kinds of base pulse widths. Each kind of base pulse width corresponds with a different kind of pulse signal, and each kind of base pulse width mutually differ. Further, this method comprises a step of determining a predetermined value. This method comprises a step of determining a pulse width of each kind of pulse signal by multiplying the corresponding base pulse width by the predetermined value.

With this method, the pulse widths of the different kinds of pulse signals may easily be determined.

FIRST EMBODIMENT

An ink jet printer 1 of a first embodiment will be described with reference to the drawings. Below, the ink jet printer 1 may simply referred to as printer 1. FIG. 1 is a schematic block diagram of the printer 1.

The printer 1 has a controller 100. The controller 100 executes general control of the operation of the printer 1. Further, the printer 1 has an operation panel 250. Information can be input using the operation panel 250. The operation panel 250 is connected with the controller 100, and the information input to the operation panel 250 is taken to the controller 100.

The printer 1 has a supply device 114. This supply device 114 has a paper housing section 115, a paper supply roller 145, a pair of rollers 118*a* and 118*b*, a pair of rollers 119*a* and 119*b*, etc. The paper housing section 115 can house a plurality of sheets of printing paper P in a stacked state. The printing paper P has a rectangular shape extending in the left-right direction of FIG. 1. The paper supply roller 145 delivers the uppermost sheet of printing paper P in the paper housing section 115 in the direction of the arrow P1. The printing paper P that was transported in the direction of the arrow P1 is then transported in the direction of the arrow P2 by the pair of rollers 118*a* and 118*b* and the pair of rollers 119*a* and 119*b*.

The printer 1 has a conveying unit 120. The conveying unit 120 conveys the printing paper P, that has been transported in the direction of the arrow P2, in the direction P3. The conveying unit 120 has a belt 111, belt rollers 106 and 107, etc. The belt 111 is wound across the belt rollers 106 and 107. The belt 111 is adjusted to have a length such that a predetermined tension is generated when it is wound across the belt rollers 106 and 107. The belt 111 has an upper face 111*a* that is located above the belt rollers 106 and 107, and a lower face 111*b* that is located below the belt rollers 106 and 107. The first belt roller 106 is connected to a conveying motor 147. The conveying motor 147 is caused to rotate by the controller 100. The other belt roller 107 rotates following the rotation of the belt roller 106. When the belt rollers 106 and 107 rotate, the printing paper P mounted on the upper face 111*a* of the belt 111 is conveyed in the direction shown by the arrow P3.

A pair of nip rollers 138 and 139 are disposed near the belt roller 107. The upper nip roller 138 is disposed at an outer peripheral side of the belt 111. The lower nip roller 139 is disposed at an inner peripheral side of the belt 111. The belt 111 is gripped between the pair of nip rollers 138 and 139. The nip roller 138 is energized downwards by a spring (not shown). The nip roller 138 pushes the printing paper P onto the upper face 111*a* of the belt 111. In the present embodiment, an outer peripheral face of the belt 111 comprises adhesive silicon gum. As a result, the printing paper P adheres reliably to the upper face 111*a* of the belt 111.

A sensor 133 is disposed to the left of the nip roller 138. The sensor 133 is a light sensor comprising a light emitting element and a light receiving element. The sensor 133 detects a tip of the printing paper P. Detection signals of the sensor 133 are sent to the controller 100. The controller 100 can determine that the printing paper P has reached a detecting position when the detection signals from the sensor 133 are input.

The printer 1 has a head unit 2. The head unit 2 is located above the conveying unit 120. The head unit 2 has four ink jet heads 2*a*, 2*b*, 2*c*, and 2*d*. The ink jet heads 2*a* to 2*d* are all fixed to a printer main body (not shown). The ink jet heads 2*a* to 2*d* have ink discharging faces 13*a* to 13*d* respectively. The ink discharging faces 13*a* to 13*d* are formed at lower faces of the ink jet heads 2*a* to 2*d*. Ink is discharged downwards from the ink discharging faces 13*a* to 13*d* of the ink jet heads 2*a* to 2*d*. Each ink jet head 2*a* to 2*d* has an approximately rectangular parallelepiped shape that extends in a perpendicular direction relative to the plane of the page of FIG. 1. Magenta (M) ink is discharged from the ink jet head 2*a*. Yellow (Y) ink is discharged from the ink jet head 2*b*. Cyan (C) ink is discharged from the ink jet head 2*c*. Black (K) ink is discharged from the ink jet head 2*d*. In the present embodiment, four colors of ink can be used to perform color printing of the printing paper P. The configuration of the ink jet heads 2*a* to 2*d* will be described in detail later. The operation of the ink jet heads 2*a* to 2*d* is controlled by the controller 100.

A space is formed between the ink discharging faces 13*a* to 13*d* of the ink jet heads 2*a* to 2*d* and the upper face 111*a* of the belt 111. The printing paper P is transported towards the left (in the direction of the arrow P3) along this space. Ink is discharged from the ink jet heads 2*a* to 2*d* onto the printing paper P during this process of delivery in the direction of the arrow P3. The printing paper P is thus printed with color words or images. In the present embodiment, the ink jet heads 2*a* to 2*d* are fixed. That is, the printer 1 of the present embodiment is a line type printer.

A plate 140 is supplied to the left of the conveying unit 120. When the printing paper P is transported in the direction of the arrow P3, a right edge of the plate 140 enters between the printing paper P and the belt 111, thus separating the printing paper P from the belt 111.

A pair of rollers 121*a* and 121*b* is formed to the left of the plate 140. Further, a pair of rollers 122*a* and 122*b* is formed above the pair of rollers 121*a* and 121*b*. The printing paper P, which has been transported in the direction of the arrow P3, is transported in the direction of an arrow P4 by the pair of rollers 121*a* and 121*b* and the pair of rollers 122*a* and 122*b*. A paper discharge section 116 is disposed to the right of the rollers 122*a* and 122*b*. The printing paper P that has been transported in the direction of the arrow P4 is received in the paper discharge section 116. The paper discharge section 116 can maintain a plurality of printed sheets of printing paper P in a stacked state.

Next, the configuration of the ink jet head 2*a* will be described. Since the other ink jet heads 2*b* to 2*d* have the same configuration as the ink jet head 2*a*, a detailed description thereof will be omitted.

Figure 2:
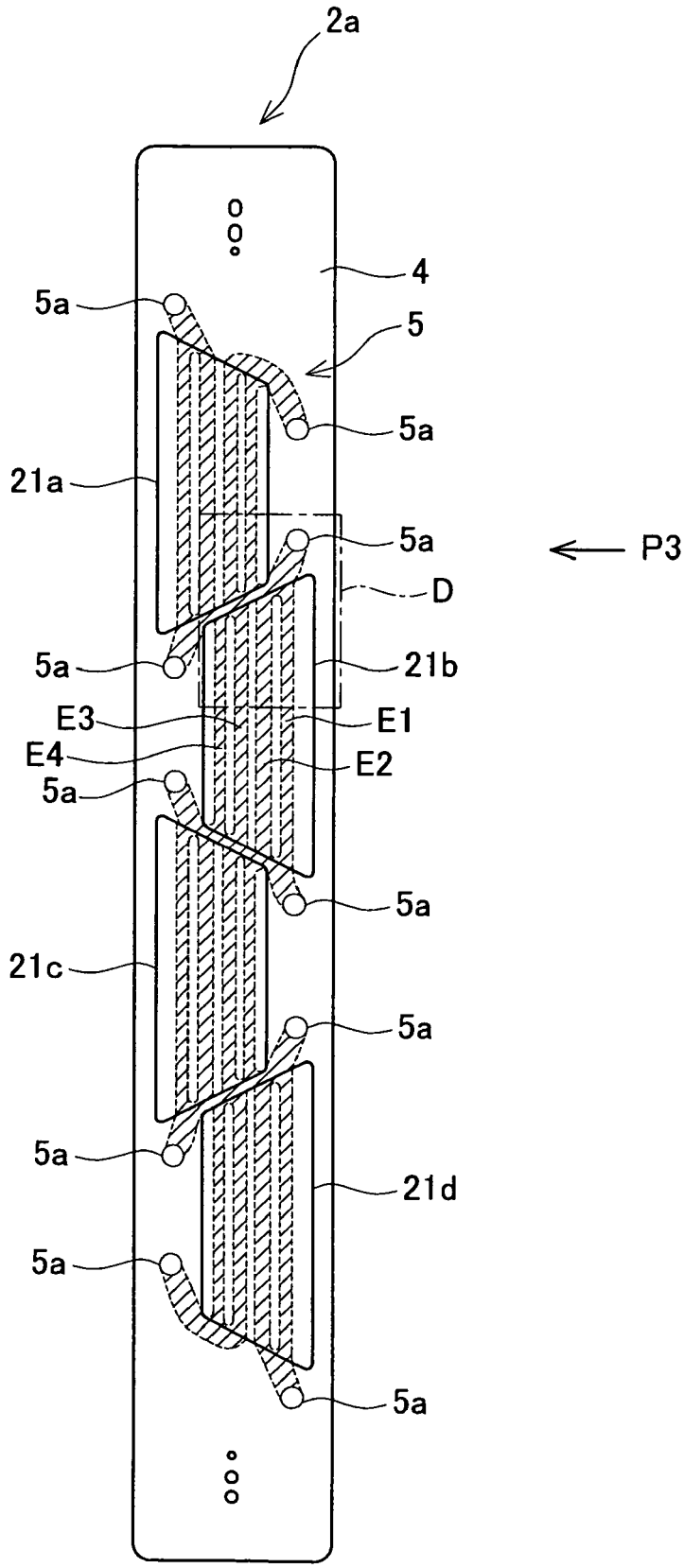
FIG. 2 shows a plan view of an ink jet head.

FIG. 2 shows a plan view of the ink jet head 2*a* viewed from an upper side of FIG. 1. The ink jet head 2*a* has a passage unit 4 and four actuator units 21*a*, 21*b*, 21*c*, and 21*d*.

Ink passages 5 are formed within the passage unit 4. In FIG. 2, main ink passages 5 within the passage unit 4 are shown by hatching. A plurality of openings 5*a* is formed in an upper face (a face of a proximate side perpendicular to the plane of FIG. 2) of the passage unit 4. These openings 5*a* are connected to an ink tank (not shown). In the case of the ink jet head 2*a*, the openings 5*a* are connected to an ink tank that houses magenta ink. The ink in the ink tank is led into the passage unit 4 via the openings 5*a*. The ink discharging face 13*a* is formed at a lower face (a face of a far side perpendicular to the plane of FIG. 2) of the passage unit 4.

The ink passages 5 of the passage unit 4 have ink chambers E1 to E4. The ink chambers E1 to E4 are formed in a region that faces the actuator units 21*a* to 21*d*. In FIG. 2, reference numbers have been applied only to the ink chambers E1 to E4 facing the actuator unit 21*b*. Actually, however, four ink chambers are also formed in a region facing the actuator unit 21*a*, and four ink chambers are formed respectively in regions facing the actuator units 21*c* and 21*d*. The ink chambers E1 to E4 extend in the up-down direction of FIG. 2. The ink chambers E1 to E4 are aligned so as to be parallel in the left-right direction of FIG. 2. The ink chambers E1 to E4 are filled with ink that is introduced from the ink tank via the openings 5*a*.

The four actuator units 21*a* to 21*d* are fixed to the upper face of the passage unit 4. The actuator units 21*a* to 21*d* each have a trapezoid shape when viewed from a plan view. The actuator units are aligned in the sequence 21*a*, 21*b*, 21*c*, and 21*d* from an upper side of FIG. 2. The actuator units 21*a* and 21*c* are disposed such that short edges thereof are at the right side and long edges thereof are at the left side. The actuator units 21*b* and 21*d* are disposed such that short edges thereof are at the left side and long edges thereof are at the right side. The actuator units 21*a* and 21*b* are disposed so as to overlap in the left-right direction of FIG. 2. Further, the actuator units 21*a* and 21*b* are disposed so as to overlap in the up-down direction of FIG. 2. Similarly, the actuator units 21*b* and 21*c* are disposed so as to overlap in the left-right direction and the up-down direction. The actuator units 21*c* and 21*d* are disposed so as to overlap in the left-right direction and the up-down direction.

An FPC (Flexible Printed Circuit: not shown) is connected to the actuator units 21*a* to 21*d*. The FPC applies pulse signals (discharge signals) to the actuator units 21*a* to 21*d*. The actuator units 21*a* to 21*d* increase or reduce pressure of ink within pressure chambers 10 (to be described: see FIG. 3, etc.) of the passage unit 4 in response to the pulse signals. Ink is thus discharged from the passage unit 4.

Below, unless otherwise specified, the actuator units 21*a* to 21*d* are represented as the reference number 21.

Figure 3:
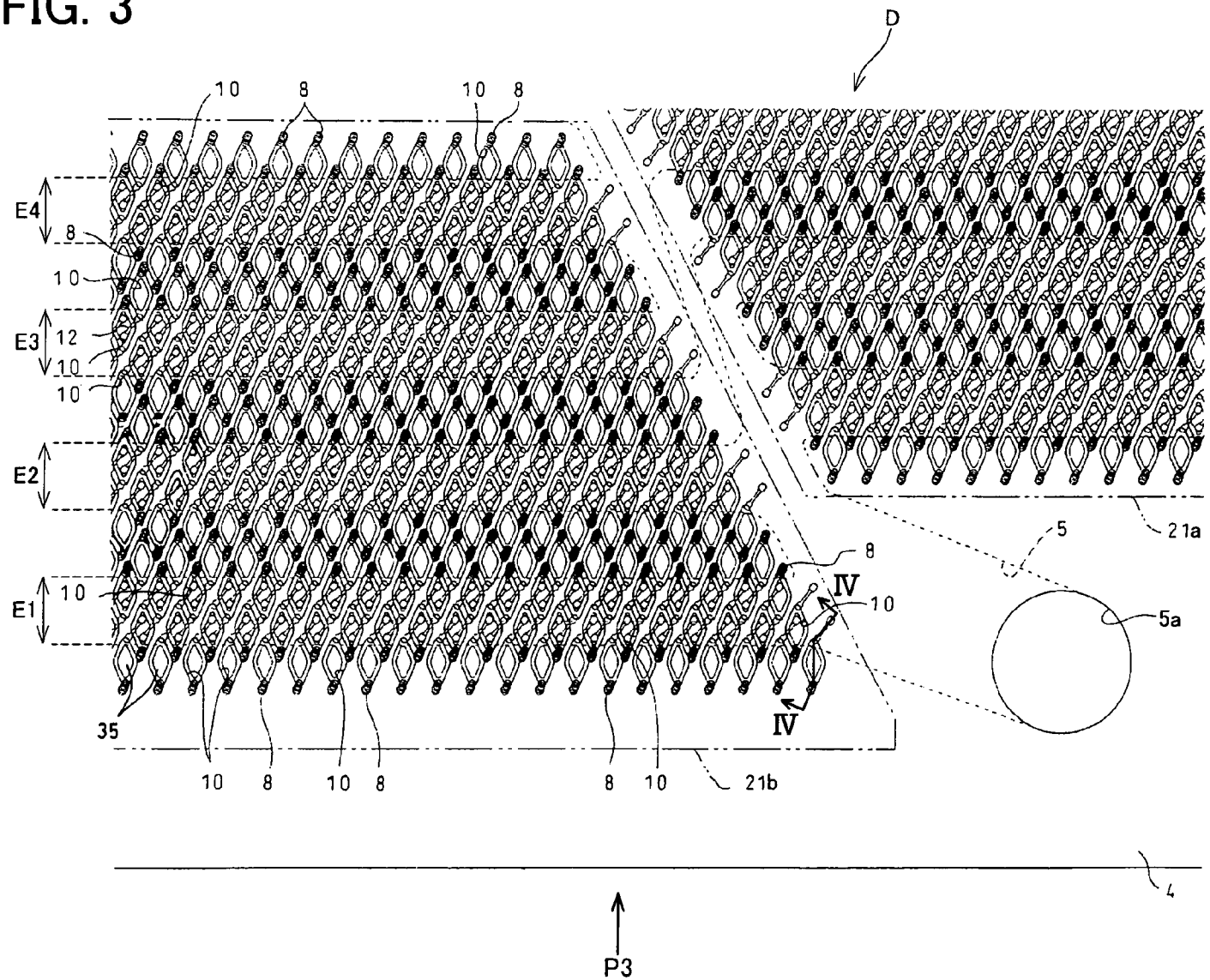
FIG. 3 shows an expanded view of a region D of FIG. 2.

FIG. 3 is an expanded plan view of a region D of FIG. 2. In FIG. 3, nozzles 8, pressure chambers 10, and apertures 12 which actually cannot be seen are shown by solid lines.

As shown in FIG. 3, a plurality of nozzles 8, a plurality of pressure chambers 10 and a plurality of apertures 12, etc. are formed within the passage unit 4. The number of nozzles 8, of pressure chambers 10, and of apertures 12 is identical. In FIG. 3, not all the nozzles 8, pressure chambers 10, and apertures 12 are numbered.

The actuator unit 21 has a plurality of individual electrodes 35. One individual electrode 35 corresponds to one pressure chamber 10. The number of individual electrodes 35 is identical with the number of pressure chambers 10.

Figure 4:
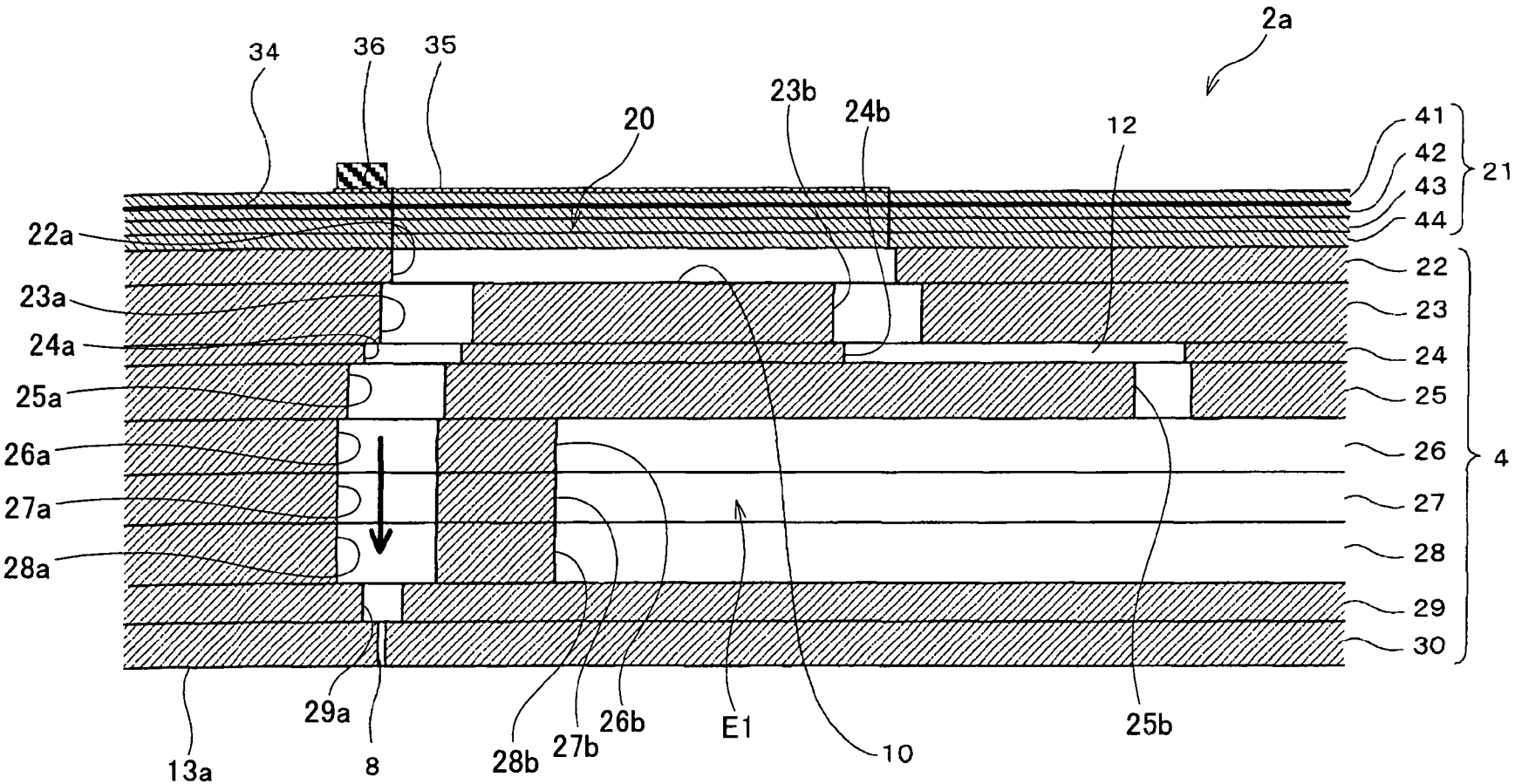
FIG. 4 shows a cross-sectional view along the line IV-IV of FIG. 3.

The configuration of the passage unit 4 and the actuator unit 21 will be described in detail with reference to FIG. 4. FIG. 4 is a cross-sectional view along the line IV-IV of FIG. 3.

The passage unit 4 is a structure in which nine metal plates 22 to 30 have been stacked. The nozzles 8 are formed in a nozzle plate 30, and pass through this nozzle plate 30. Only one nozzle 8 is shown in FIG. 4. However, a plurality of nozzles 8 is actually formed (see FIG. 3).

A cover plate 29 is stacked on a surface of the nozzle plate 30. A plurality of through holes 29*a* is formed in the cover plate 29. The through holes 29*a* are formed in positions corresponding to the nozzles 8 of the nozzle plate 30.

Three manifold plates 26, 27, and 28 are stacked on a surface of the cover plate 29. A through hole 26*a* is formed in the manifold plate 26. A through hole 27*a* is formed in the manifold plate 27, and a through hole 28*a* is formed in the manifold plate 28. The through holes 26*a*, 27*a*, and 28*a* are formed in a position corresponding to the through hole 29*a* of the cover plate 29. The manifold plates 26, 27, and 28 have long holes 26*b*, 27*b*, and 28*b* respectively. The long holes 26*b*, 27*b*, and 28*b* have the shape of the ink passages 5 shown in FIGS. 2 and 3. The long holes 26*b*, 27*b*, and 28*b* are each formed in the same position. Spaces formed by the long holes 26*b*, 27*b*, and 28*b* are the ink passages 5. In FIG. 4, the ink chamber E1, which is a part of the ink passage 5, is shown.

A supply plate 25 is stacked on a surface of the manifold plate 26. A through hole 25*a* is formed in the supply plate 25. The through hole 25*a* is formed in a position corresponding to the through hole 26*a* of the manifold plate 26. Further, a through hole 25*b* is formed in the supply plate 25. The through hole 25*b* is formed in a position corresponding to the long hole 26*b* of the manifold plate 26.

An aperture plate 24 is stacked on a surface of the supply plate 25. A through hole 24*a* is formed in the aperture plate 24. The through hole 24*a* is formed in a position corresponding to the through hole 25*a* of the supply plate 25. Further, a long hole 24*b* is formed in the aperture plate 24. Right edge of the long hole 24*b* is formed in a position corresponding to the through hole 25*b* of the supply plate 25. The long hole 24*b* functions as the aperture 12.

A base plate 23 is stacked on a surface of the aperture plate 24. A through hole 23*a* is formed in the base plate 23. The through hole 23*a* is formed in a position corresponding to the through hole 24*a* of the aperture plate 24. Further, a through hole 23*b* is formed in the base plate 23. The through hole 23*b* is formed in a position corresponding to left edge of the long hole 24*b* of the aperture plate 24.

A cavity plate 22 is stacked on a surface of the base plate 23. A long hole 22*a* is formed in the cavity plate 22. Left edge of the long hole 22*a* is formed in a position corresponding to the through hole 23*a* of the base plate 23. Right edge of the long hole 22*a* is formed in a position corresponding to the through hole 23*b* of the base plate 23. The long hole 22*a* functions as the pressure chamber 10. The pressure chamber 10 communicates with the ink chamber E1 via the through hole 23*b*, the aperture 12, and the through hole 25*b*. Further, the pressure chamber 10 communicates with the nozzle 8 via the through hole 23*a*, the through hole 24*a*, the through hole 25*a*, the through hole 26*a*, the through hole 27*a*, the through hole 28*a*, and the through hole 29*a*.

As shown in FIG. 3, the pressure chambers 10 are substantially diamond shaped when viewed from a plan view. The plurality of pressure chambers 10 is disposed in a staggered pattern. One pressure chamber row is formed by aligning a plurality of the pressure chambers 10 in a direction orthogonal to the direction of the arrow P3 (the left-right direction of FIG. 3). Sixteen pressure chamber rows are aligned in the direction of P3 within a region corresponding to one actuator unit 21. Each pressure chamber 10 communicates with one out of the ink chambers E1 to E4.

One nozzle row is formed by aligning a plurality of the nozzles 8 in a direction orthogonal to the direction of the arrow P3. Sixteen nozzle rows are aligned in the direction of P3 within a region corresponding to one actuator unit 21. Each nozzle 8 communicates with one out of the pressure chambers 10. As shown in FIG. 3, when the ink jet head 2 is viewed from a plan view, none of the nozzles 8 overlap with the ink chambers E1 to E4.

The nozzles 8 are mutually offset in the direction orthogonal to the direction of the arrow P3. That is, if the nozzles 8 are projected from the direction of P3 on a straight line (a projective line) extending in the direction orthogonal to the arrow P3, each nozzle 8 will be present at differing position on this projective line. Each nozzle 8 on the projective line is separated from an adjacent nozzle 8 with uniform space. This space is a distance corresponding to 600 dpi. This 600 dpi is the resolution in the direction orthogonal to the arrow P3.

Returning to FIG. 4, the configuration of the actuator unit 21 will be described. The actuator unit 21 is connected to the surface of the cavity plate 22. Actually, the four actuator units 21*a* to 21*d* are connected to the cavity plate 22.

The actuator unit 21 comprises four piezoelectric sheets 41, 42, 43, and 44, a common electrode 34, the individual electrodes 35, etc. The thickness of each of the piezoelectric sheets 41 to 44 is approximately 15 μm. The thickness of the actuator unit 21 is approximately 60 μm. Each of the piezoelectric sheets 41 to 44 has approximately the same area as the one actuator unit 21 shown in FIGS. 2 and 3. That is, the piezoelectric sheets 41 to 44 each have a trapezoid shape when viewed from a plan view. The piezoelectric sheets 41 to 44 extend across the plurality of pressure chambers 10. The piezoelectric sheets 41 to 44 are formed from ferroelectric lead zirconate titanate (PZT) ceramic material.

The common electrode 34 is disposed between the uppermost piezoelectric sheet 41 and the piezoelectric sheet 42 formed below the piezoelectric sheet 41. The common electrode 34 has approximately the same area as the piezoelectric sheets 41 to 44, and has a trapezoid shape when viewed from a plan view. The common electrode 34 has a thickness of approximately 2 μm. The common electrode 34 is made from a metal material such as, for example, Ag—Pd. Electrodes are not disposed between the piezoelectric sheet 42 and the piezoelectric sheet 43, between the piezoelectric sheet 43 and the piezoelectric sheet 44, or between the piezoelectric sheet 44 and the cavity plate 22. The common electrode 34 is connected with a ground (not shown).

A plurality of the individual electrodes 35 is disposed on the surface of the uppermost piezoelectric sheet 41. Each individual electrode 35 has a thickness of 1 μM. Each individual electrode 35 is disposed in a position corresponding to different one of the pressure chambers 10. The individual electrodes 35 are made from a metal material such as, for example, Ag—Pd. A land 36 having a thickness of approximately 15 μm is formed at one end of each individual electrode 35. The lands 36 are substantially circular when viewed from a plan view, and the diameter thereof is approximately 160 μm. The individual electrode 35 and the land 36 are joined conductively. The lands 36 may be composed of, for example, metal that contains glass flit. The land 36 is electrically connected with the individual electrode 35 and with a contact formed on the FPC (not shown). The individual electrode 35 is electrically connected with a driver IC 220 (to be described; see FIG. 7) via the contact and wiring of the FPC. The driver IC 220 is controlled by the controller 100. The controller 100 can thus individually control the voltage of each of the individual electrodes 35.

Figure 5:
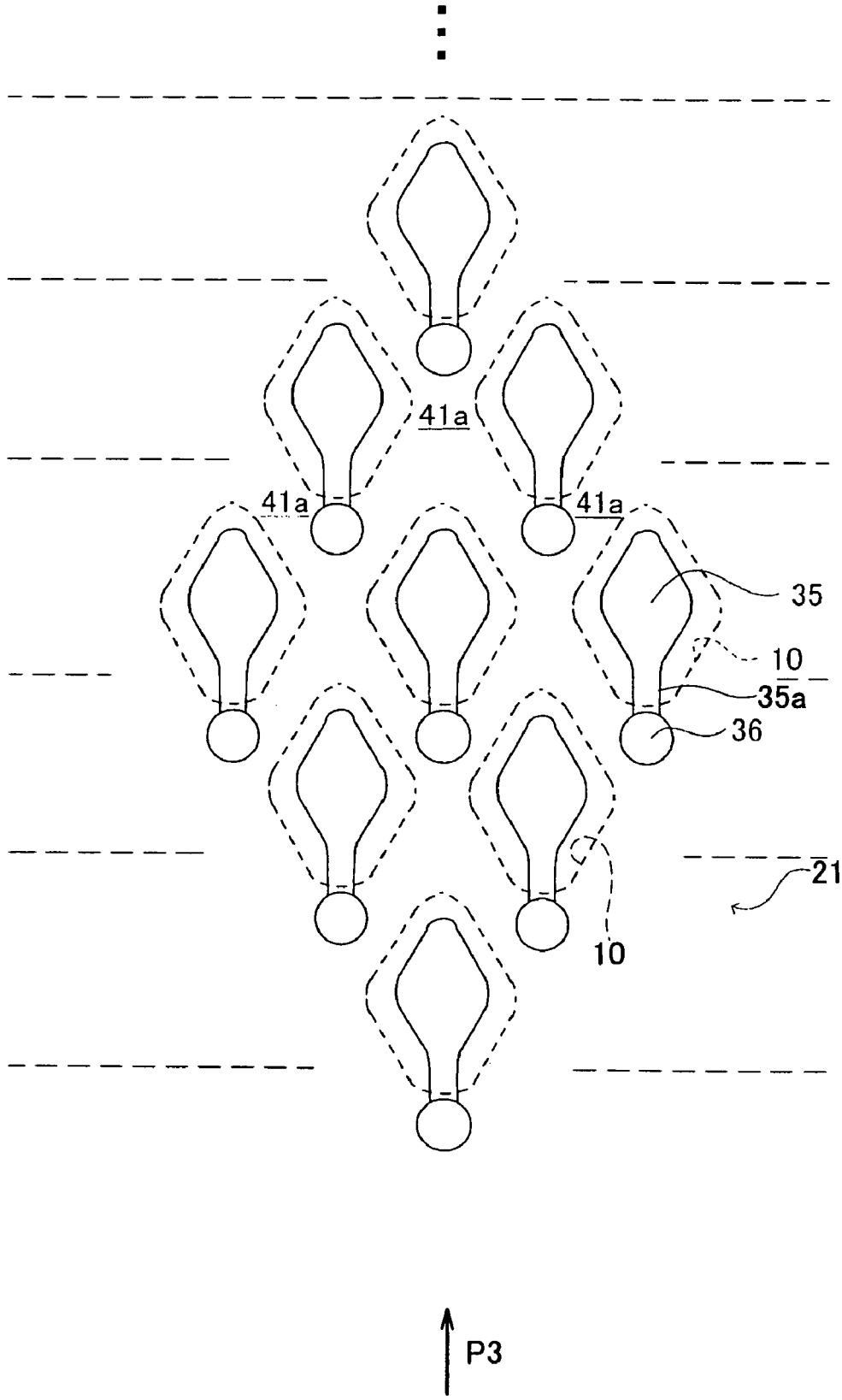
FIG. 5 shows an expanded plan view of a portion of an actuator unit.

FIG. 5 shows an expanded plan view of a portion of the actuator unit 21. As shown in FIG. 5, each of the individual electrodes 35 is substantially diamond shaped when viewed from a plan view. One individual electrode 35 faces one pressure chamber 10. The individual electrode 35 is smaller than the pressure chamber 10. The major part of the individual electrode 35 overlaps with the pressure chamber 10. A protruding part 35*a* is formed on each individual electrode 35. This protruding part 35*a* extends downwards from an acute angle of a lower side of the diamond shape. The protruding part 35*a* extends into a region 41*a* in which the pressure chambers 10 are not formed. The lands 36 are formed in this region 41*a*.

Since one individual electrode 35 faces one pressure chamber 10, the individual electrodes 35 are disposed with the same pattern as the pattern with which the pressure chambers 10 are disposed. That is, the plurality of individual electrodes 35 forms electrode rows that are aligned in the direction orthogonal to the arrow P3. Sixteen electrode rows are aligned in the direction of the arrow P3 within one actuator unit 21.

In the present embodiment, the individual electrodes 35 are formed only on the surface of the actuator unit 21. As will be described in detail later, only the piezoelectric sheet 41 between the common electrode 34 and the individual electrodes 35 forms an activated part of the piezoelectric sheets. With this type of configuration, the unimorph deformation in the actuator unit 21 has superior deformation efficiency.

When a voltage difference is applied between the common electrode 34 and the individual electrodes 35, a region of the piezoelectric sheet 41 to which the electric field is applied deforms due to piezoelectric effects. The deformation part functions as an active part. The piezoelectric sheet 41 can expand and contract in its direction of thickness (the stacking direction of the actuator unit 21) and in its planer direction. The other piezoelectric sheets 42 to 44 are non-active layers that are not located between the individual electrodes 35 and the common electrode 34. Consequently, they cannot deform spontaneously even when a voltage difference is applied between the individual electrodes 35 and the common electrode 34. In the actuator unit 21, the upper piezoelectric sheet 41 that is farther from the pressure chambers 10 is the active part, and the lower piezoelectric sheets 42 to 44 that are closer to the pressure chambers 10 are non-active parts. This type of actuator unit 21 is termed a unimorph type.

When voltage difference is applied between the common electrode 34 and the individual electrodes 35 such that the direction of the electric field and the direction of polarization have the same direction, the active part of the piezoelectric sheet 41 contracts in a planar direction. By contrast, the piezoelectric sheets 42 to 44 do not contract. There is thus a difference in the rate of contraction of the piezoelectric sheet 41 and the piezoelectric sheets 42 to 44. As a result, the piezoelectric sheets 41 to 44 (including the individual electrodes 35) deform so as to protrude towards the pressure chamber 10 side. The pressure in the pressure chambers 10 is thus increased. By contrast, when there is zero voltage difference between the common electrode 34 and the individual electrodes 35, the state wherein the piezoelectric sheets 41 to 44 protrude towards the pressure chamber 10 side is released. The pressure in the pressure chambers 10 is thus decreased.

The voltage of the individual electrodes 35 is controlled individually. There is deformation of the parts of the piezoelectric sheets 41 to 44 facing the individual electrodes 35 in which the voltage has been changed. One piezoelectric element 20 (see FIG. 4) is formed from one individual electrode 35 and the region facing that individual electrode 35 (the region of the piezoelectric sheets 41 to 44 (i.e. the common electrode 35)). Only one piezoelectric element 20 has been shown in FIG. 4. However, there is the same number of piezoelectric elements 20 as the number of individual electrodes 35 (the same number as the number of pressure chambers 10). The piezoelectric elements 20 are disposed with the same pattern as the pattern with which the individual electrodes 35 are disposed. That is, one element row is formed from a plurality of the piezoelectric elements 20 that are aligned in the direction of P3. Sixteen element rows are aligned in the direction of P3 within one actuator unit 21. The voltage of each piezoelectric element 20 is controlled individually by the controller 100.

The operation of the ink jet head 2 configured as described above will be described with reference to FIG. 6(A) to (C). A pulse signal S is applied to the piezoelectric element 20 (the individual electrode 35) corresponding to the nozzle 8 so as to discharge an ink droplet from that nozzle 8.

When printing is not being performed, a voltage higher than the voltage of the common electrode 34 is maintained in the individual electrode 35 (the region X of the pulse signal in FIG. 6(A)). In this state, the piezoelectric element 20 protrudes towards the pressure chamber 10 side (see FIG. 6(A)).

Figure 6:
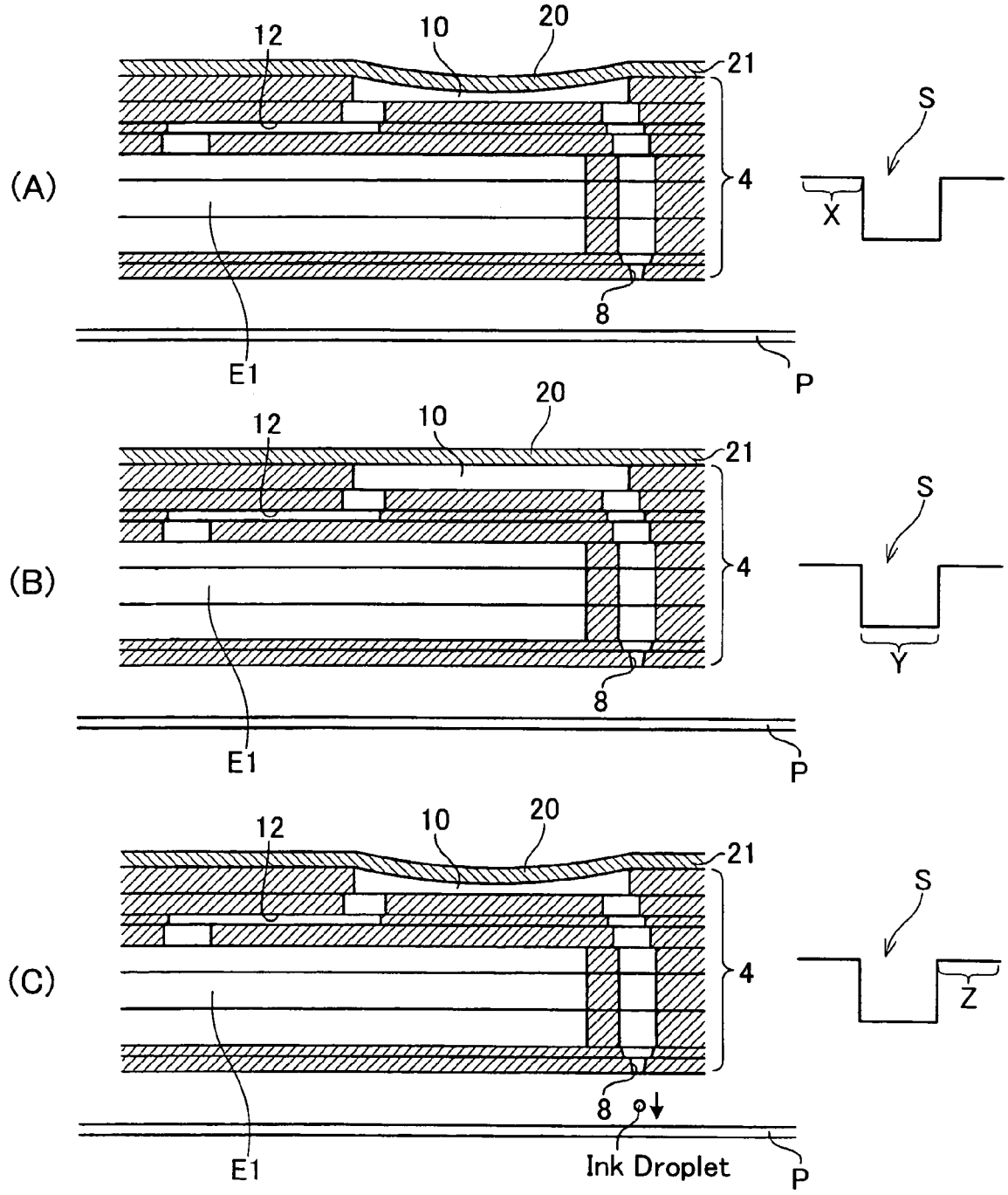
FIG. 6 shows a time sequence of changes of a piezoelectric element when one pulse signal is applied to the piezoelectric element.

The individual electrode 35 of the piezoelectric element 20 is made to have the same voltage as the common electrode 34 (the region Y of the pulse signal in FIG. 6(B)). The piezoelectric element 20 thus deforms upwards relative to FIG. 6, and the pressure in the pressure chamber 10 is decreased. In this state, the piezoelectric element 20 is the state shown in FIG. 6 (B). When the pressure in the pressure chamber 10 decreases, the ink in the ink chamber E1 is led into the pressure chamber 10 via the aperture 12. The pressure chamber 10 is thus filled with ink.

Next, the individual electrode 35 of the piezoelectric element 20 is returned to high voltage (the region Z of the pulse signal in FIG. 6(C)). The piezoelectric element 20 deforms downwards, and the pressure in the pressure chamber 10 increases. The ink in the pressure chamber 10 is thus pressurized. One ink droplet is thus discharged from the nozzle 8. When one ink droplet adheres to the printing paper P, one dot is formed.

As described above, in order to discharge one ink droplet from the nozzle 8, a pulse signal in which a high voltage is the standard is applied to the piezoelectric element 20. The technique of the present embodiment is termed 'fill before fire'. If a pulse width of the pulse signal (i.e. the period of the region Y in FIG. 6(B)) is set to the time taken for a pressure wave to be proceeded from the nozzle 8 to an opening of the aperture 12 (the left edge in FIG. 6(A) etc.), the discharge speed of the ink droplet will be at its maximum.

As described above, one dot may be formed by discharging one ink droplet from the nozzle 8. This is termed single discharging.

In the present embodiment, one dot may be formed by continuously discharging two ink droplets from the nozzle 8. This is termed double discharging. In the case of double discharging, two pulse signals are applied continuously to the piezoelectric element 20. In this case, the deformation of the piezoelectric element 20 as shown in FIGS. 6(A) to(C) is performed twice. Two ink droplets are thus continuously discharged from the nozzle 8. Usually, the second of these ink droplets has a faster discharge speed than the first of these ink droplets. As a result, the two ink droplets merge before reaching the printing paper P, and form one ink droplet. When this one ink droplet adheres to the printing paper P, one dot is formed. This dot is larger than a dot formed by the single discharging.

Further, in the present embodiment, one dot may be formed by continuously discharging three ink droplets from the nozzle 8. This is termed triple discharging. In the case of triple discharging, three pulse signals are applied continuously to the piezoelectric element 20. In this case, three ink droplets are thus continuously discharged from the nozzle 8. The three ink droplets merge before reaching the printing paper P, and form one ink droplet. When this one ink droplet adheres to the printing paper P, one dot is formed. This dot is larger than a dot formed by the double discharging.

The user of the printer 1 may select either of two printing modes. When the user selects printing mode 1, the printer 1 performs printing using only single discharging. When the user selects printing mode 2, the printer 1 performs printing using a mixture of single discharging, double discharging and triple discharging. That is, the dots are formed on one sheet of printing paper P utilizing all of single discharging, double discharging and triple discharging. Dots of differing sizes are therefore formed on one sheet of printing paper P. In this case, there is a richer graduation than in the case of the printing mode 1.

Next, the configuration of the controller 100 for controlling the ink jet heads 2*a* to 2*d* will be described. The controller 100 prints on the printing paper P by causing ink to be discharged from the nozzles 8 while moving the printing paper P in the direction of the arrow P3.

Figure 7:
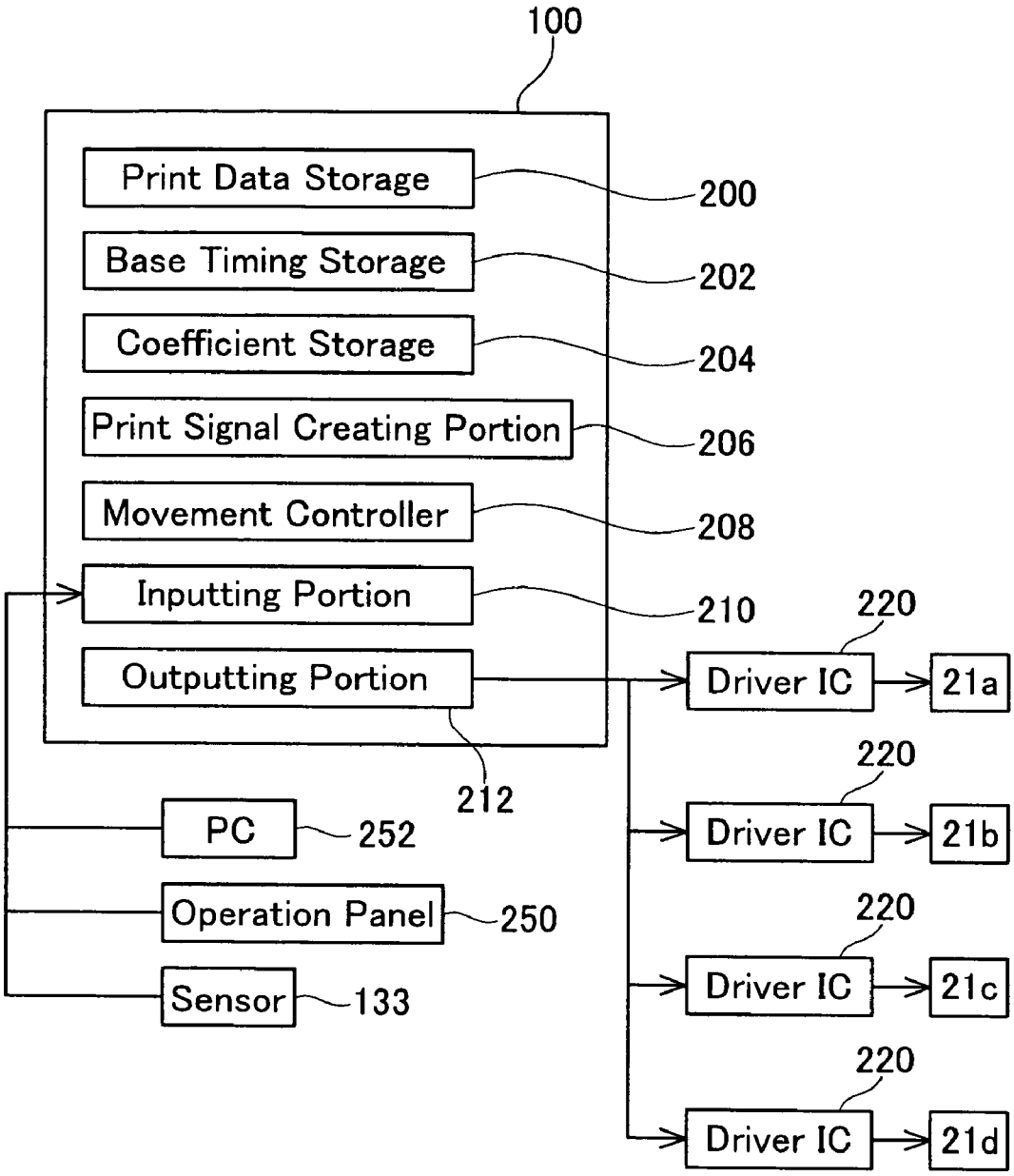
FIG. 7 shows the circuit configuration of a controller and its surrounds.

FIG. 7 is a block view showing the functions of the controller 100. The controller 100 comprises a CPU (Central Processing Unit), a ROM (Read Only Memory), a RAM (Random Access Memory), etc. Each section in FIG. 7 is constructed by performing these functions. The CPU is a processing unit. The CPU executes programs stored in the ROM. The ROM stores programs to be executed by the CPU, and stores data used in the execution of these programs. The RAM temporarily stores data.

The controller 100 comprises a print data storage 200, a base timing storage 202, a coefficient storage 204, a print signal creating portion 206, a movement controller 208, an inputting portion 210, and an outputting portion 212, etc.

The print data storage 200 stores print data output from a PC 252. The print data will be described later. Furthermore, the print data storage 200 can store the printing mode selected by the user.

Figures 8, 9:
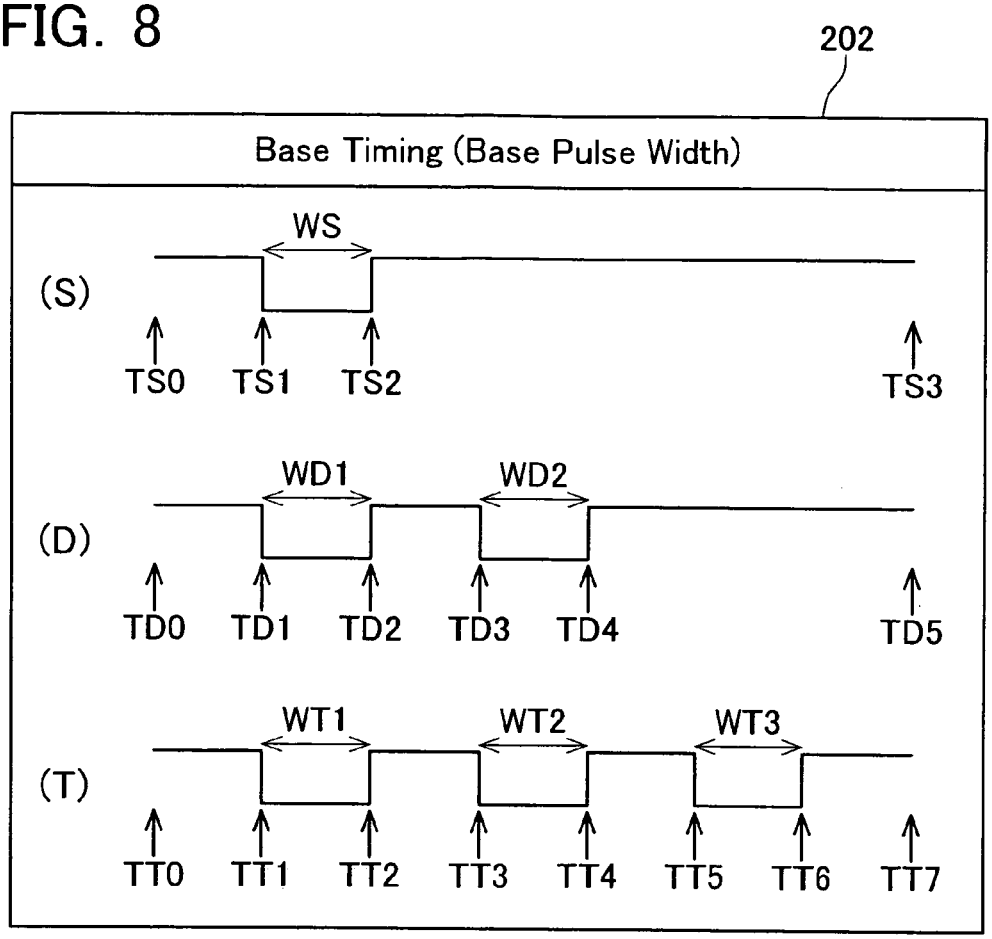
FIG. 8 shows an example of contents stored in a base timing storage.
FIG. 9 shows an example of contents stored in a coefficient storage.

The base timing storage 202 stores the timing of rises and falls of base pulse signals. FIG. 8 schematically shows contents stored in the base timing storage 202. In FIG. 8, (S) corresponds to single discharging, (D) corresponds to double discharging, and (T) corresponds to triple discharging. The base timing storage 202 stores the base pulse signals for single discharging, for double discharging, and for triple discharging.

For single discharging, the base timing storage 202 stores TS0 to TS3. In the case where TS0 is zero, the base timing storage 202 stores 'a fall time TS1, a rise time TS2, and one printing period ending time TS3.' The difference between the time TS1 and the time TS2 is a pulse width WS of the base pulse signal for single discharging.

For double discharging, the base timing storage 202 stores TD0 to TD5. In the case where TD0 is zero, the base timing storage 202 stores 'a first fall time TD1, a first rise time TD2, a second fall time TD3, a second rise time TD4, and one printing period ending time TD5.' The difference between the time TD1 and the time TD2 is a first pulse width WD1 of the base pulse signal for double discharging. The difference between the time TD3 and the time TD4 is a second pulse width WD2 of the base pulse signal for double discharging. In the present embodiment, the time between TD2 and TD3 is identical with the time between TD1 and TD2 (i.e. WD1). TS3 and TD5 are identical.

For triple discharging, the base timing storage 202 stores TT0 to TT7. In the case where TT0 is zero, the base timing storage 202 stores 'a first fall time TT1, a first rise time TT2, a second fall time TT3, a second rise time TT4, a third fall time TT5, a third rise time TT6, and one printing period ending time TD7.' The difference between the time TT1 and the time TT2 is a first pulse width WT1 of the base pulse signal for triple discharging. The difference between the time TT3 and the time TT4 is a second pulse width WT2 of the base pulse signal for triple discharging. The difference between the time TT5 and the time TT6 is a third pulse width WT3 of the base pulse signal for triple discharging. In the present embodiment, the time between TT2 and TT3 is identical with the time between TT1 and TT2 (i.e. WT1). Further, the time between TT4 and TT5 is identical with the time between TT3 and TT4 (i.e. WT2). TT7, TS3 and TD5 are identical.

The manner in which the base pulse signals are obtained will be described in detail later.

The coefficient storage 204 stores coefficients for each of the actuator units 21. FIG. 9 shows a simplification of contents stored in the coefficient storage 204. The coefficient storage 204 stores a plurality of combinations of one actuator unit 21 and one coefficient. The printer 1 of the present embodiment has four ink jet heads 2*a* to 2*d*, and four actuator units 21*a* to 21*d* are present for each of the ink jet heads 2*a* etc. As a result, there are sixteen actuator units 21. The coefficient storage 204 stores the coefficients for each of the sixteen actuator units 21. That is, sixteen coefficients α1 to α16 are stored.

The manner in which the coefficients are determined will be described in detail later. Further, the manner in which the coefficients are utilized will be described next.

The print signal creating portion 206 of FIG. 7 creates print signals based on the print data stored in the print data storage 200 and on the printing mode. The print data has been output from the PC 252. The print data includes information showing the coordinate and color of a dot to be formed on the printing paper P. The printing mode has been input by the user. The print signal is data showing which pulse signal (single, double, or triple) should be applied to which piezoelectric element 20 with which timing.

For example, the print data includes information showing that a dot should be formed at a coordinate (xA, yB). The print signal creating portion 206 can specify the piezoelectric element 20 (in this case 20A) for forming the dot at the coordinate (xA, yB).

As described above, TS3, TD5, and TT7 (see FIG. 8) are identical in the present embodiment. That is, the time (this is termed the printing period) for forming one dot is identical for single discharging, double discharging, and triple discharging. As a result, printing can be performed using all of single discharging, double discharging, and triple discharging within one printing period. In this case, the dots formed within one printing period may include dots formed by single discharging, dots formed by double discharging, and dots formed by triple discharging. The printing period is executed repeatedly while the printing paper P is being moved in the direction P3 (see FIG. 1, etc.). Dots can thus be formed at all coordinates on the printing paper P.

In order to form the dot at the coordinate (xA, yB), the print signal creating portion 206 specifies the printing period in which the pulse signal should be applied to the piezoelectric element 20A. In this example, this is a printing period B.

Based on the printing mode, the print signal creating portion 206 determines the size of the dot (i.e. single discharging, double discharging, or triple discharging) to be formed at the coordinate (xA, yB).

The piezoelectric element to which the pulse signal should be applied (20A), and the printing period (B), the number of pulse signals (single, double, or triple) is specified by the process executed up to this point.

The print signal creating portion 206 specifies the time at which the pulse signal rises and falls corresponding to the number of pulse signals. This process is executed as follows. For example, in the case of single discharging, TS1 and TS2 for single discharging (see FIG. 8) are read from the base timing storage 202. Further, the coefficient of the actuator unit 21 that has the piezoelectric element 20A (here, this coefficient is α1) is read from the coefficient storage 204. Then TS1 and TS2 are each multiplied by the coefficient that has been read. In the case of the example, α1×TS1 and α1×TS2 are obtained. TS3 is not multiplied by the coefficient. That is, the printing period is fixed.

As another example, in the case of double discharging, TD1, TD2, TD3 and TD4 (see FIG. 8) for double discharging are read from the base timing storage 202. Then each is multiplied by the coefficient. In the case of the example, α1×TD1, α1×TD2, α1×TD3, and α1×TD4 are obtained. TD5 is not multiplied by the coefficient.

As yet another example, in the case of triple discharging, TT1, TT2, TT3, TT4, TT5, and TT6 (see FIG. 8) are read from the base timing storage 202. Then each is multiplied by the coefficient. In the case of the example, α1×TT1, α1×TT2, α1×TT3, α1×TT4, α1×TT5, and α1×TT6 are obtained. TT7 is not multiplied by the coefficient.

The print signal creating portion 206 can create the information for forming one dot by going through the above processes. That is, the print signal creating portion 206 can create the information (the print signal) having the combination of the piezoelectric element to which the pulse signal should be applied (for example, 20A), the printing period (B), and the timing with which the pulse signal rises and falls (for example, α1×TS1 and α1×TS2). The print signal creating portion 206 creates the aforementioned information for all the dots to be formed on the printing paper P. The print signal created by the print signal creating portion 206 is output to the corresponding driver IC 220 via the outputting portion 212.

The movement controller 208 controls the conveying motor 147 (see FIG. 1). The printing paper P on the belt 111 is thus conveyed. In the present embodiment, the speed with which discharged printing paper P on the belt 111 is conveyed is constant. Further, the movement controller 208 controls a motor for driving the paper supply roller 145 (see FIG. 1), and controls a motor for driving the rollers 118*a*, 118*b*, 119*a*, 119*b*, 121*a*, 121*b*, 122*a*, and 122*b*.

The PC 252, the operation panel 250 (see FIG. 1), and the sensor 133 (see FIG. 1) are connected with the inputting portion 210. The PC 252 converts an image that has been instructed by the user into print data. The print data is data showing the coordinate at which the dot should be formed and the color of that dot. The PC 252 outputs the print data to the printer 1. The print data output from the PC 252 is input to the inputting portion 210. The print data that has been input to the inputting portion 210 is stored in the print data storage 200.

Information is input using the operation panel 250. For example, the user can select the printing mode utilizing the operation panel 250. The printing mode input by the user is stored in the print data storage 200. As another example, the manufacturer of the printer 1 can input the coefficients utilizing the operation panel 250. The coefficients that have been input are stored in the coefficient storage 204.

The sensor 133 outputs detection signals when the sensor 133 detects a tip of the printing paper P. The detection signals are input to the inputting portion 210. The controller 100 can determine the timing with which the pulse signals are applied to the piezoelectric elements 20 based on the detection signals input to the inputting portion 210. That is, the timing at which the first printing period should be started can be determined.

The outputting portion 212 is connected with the driver ICs 220. One driver IC 220 is prepared against one actuator unit. In FIG. 7, only four actuator units 21*a* to 21*d* of one ink jet head (for example 2*a*) and only four driver ICs 220 are shown. However, sixteen actuator units 21 and sixteen driver ICs 220 are actually present. The driver IC 220 inputs the print signals of serial type output from the controller 100. The driver IC 220 converts the serial type print signals into parallel type print signals, and amplifies the parallel type print signals. The driver IC 220 provides the parallel type print signals to the actuator units 21. The driver IC 220 is connected with each piezoelectric element 20 of the corresponding actuator unit 21.

The driver IC 220 creates pulse signals based on the information included in the print signals. For example, in the case where the print data includes the information having the combination of the piezoelectric element 20A, the printing period B, and '$\alpha$1×TS1 and $\alpha$1×TS2', a pulse signal is created: this pulse signal falls at the timing $\alpha$1×TS1 and rises at the timing $\alpha$1×TS2. Thereupon, the pulse signal that has been created is applied to the piezoelectric element 20A at the printing period B. In this case, the piezoelectric element 20A deforms for single discharging at the printing period B.

As another example, in the case where the print data includes the information having the combination of the piezoelectric element 20A, the printing period B, and '$\alpha$1×TD1, $\alpha$1×TD2, $\alpha$1×TD3, and $\alpha$1×TD4', a first pulse signal and a second pulse signal is created: this first pulse signal falls at the timing $\alpha$1×TD1 and rises at the timing $\alpha$1×TD2, and this second pulse signal falls at the timing $\alpha$1×TD3 and the pulse signal rises at the timing $\alpha$1×TD4. The two pulse signals that have been created are applied to the piezoelectric element 20A at the printing period B. In this case, the piezoelectric element 20A deforms for double discharging.

As yet another example, in the case where the print data includes the information having the combination of the piezoelectric element 20A, the printing period B, and '$\alpha$1×TT1, $\alpha$1×TT2, $\alpha$1×TT3, $\alpha$1×TT4, $\alpha$1×TT5, and $\alpha$1×TT6' a first pulse signal, a second pulse signal, and a third pulse signal are created: this first pulse signal falls at the timing $\alpha$1×TT1 and rises at the timing $\alpha$1×TT2, this second pulse signal falls at the timing $\alpha$1×TT3 and rises at the timing $\alpha$1×TT4, and this third pulse signal falls at the timing $\alpha$1×TT5 and rises at the timing $\alpha$1×TT6. The three pulse signals that have been created are applied to the piezoelectric element 20A at the printing period B. In this case, the piezoelectric element 20A deforms for triple discharging.

Figure 10:
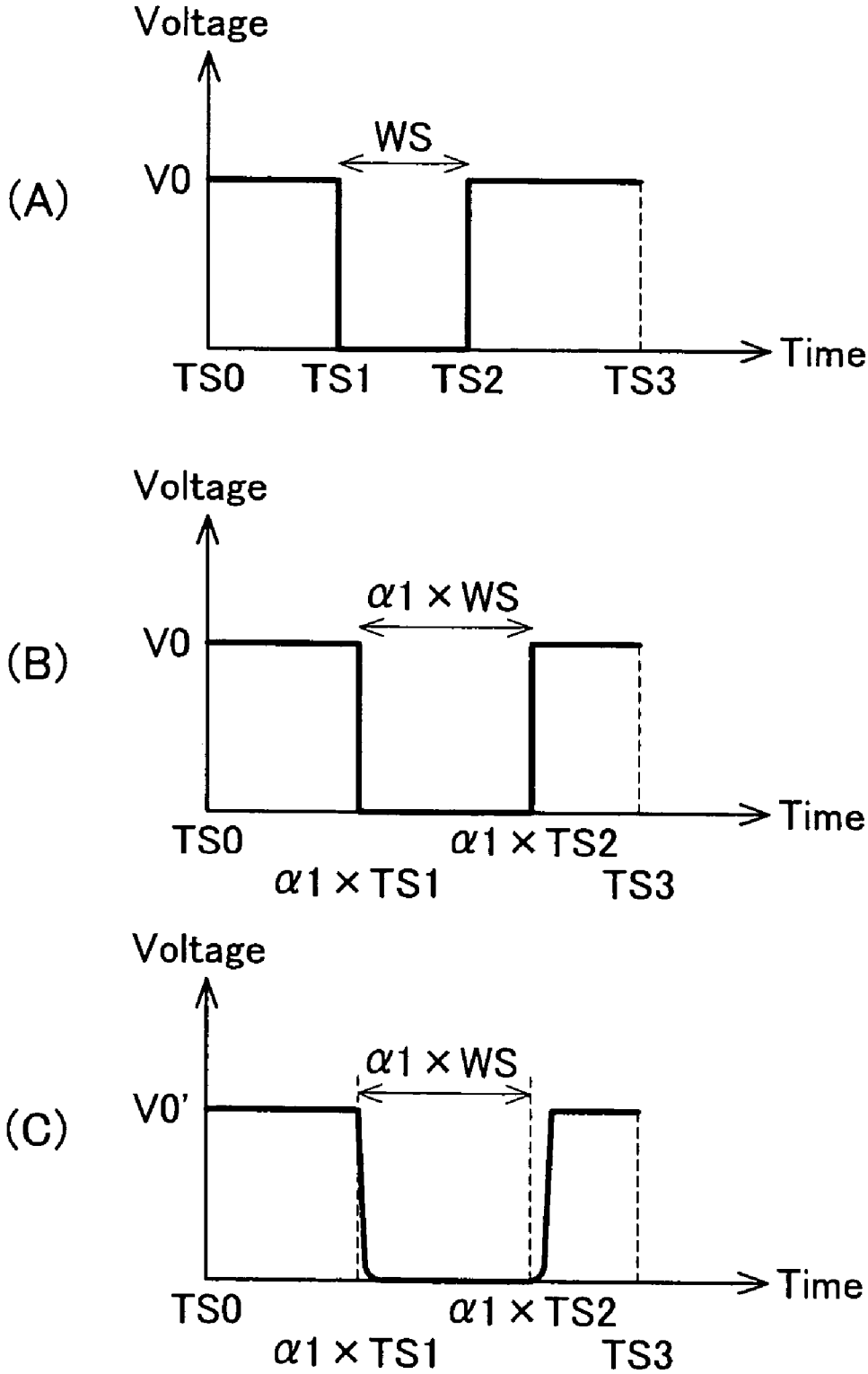
FIG. 10(A) shows base pulse signals for single discharging.
FIG. 10(B) shows pulse signals for single discharging.
FIG. 10(C) shows how voltage of the piezoelectric element changes.

FIG. 10(A) shows waveforms of the base pulse signal for single discharging. The base pulse signal can be obtained from the contents stored in the base timing storage 202.

FIG. 10(B) shows pulse signals obtained by multiplying the base pulse signal of FIG. 10(A) by the coefficient $\alpha$1. The time at which the pulse signal falls is $\alpha$1×TS1, and the time at which the pulse signal rises is $\alpha$1×TS2. The pulse width of this pulse signal is the value $\alpha$1×WS obtained by multiplying the base pulse signal WS by $\alpha$1. The ending time of the printing period is fixed at TS3.

FIG. 10(C) shows changes in the voltage of the piezoelectric element 20 to which the pulse signal of FIG. 10(B) has been applied. The piezoelectric element 20 forms a condenser due to the individual electrodes 35, the common electrode 34, and the piezoelectric sheet 41 (see FIG. 4). As a result, the voltage of the piezoelectric element 20 changes somewhat more slowly than the pulse signal. The period for the voltage of the piezoelectric element 20 to rise after it has fallen is the same as the pulse width $\alpha$1×WS of FIG. 10(B).

Figure 11:
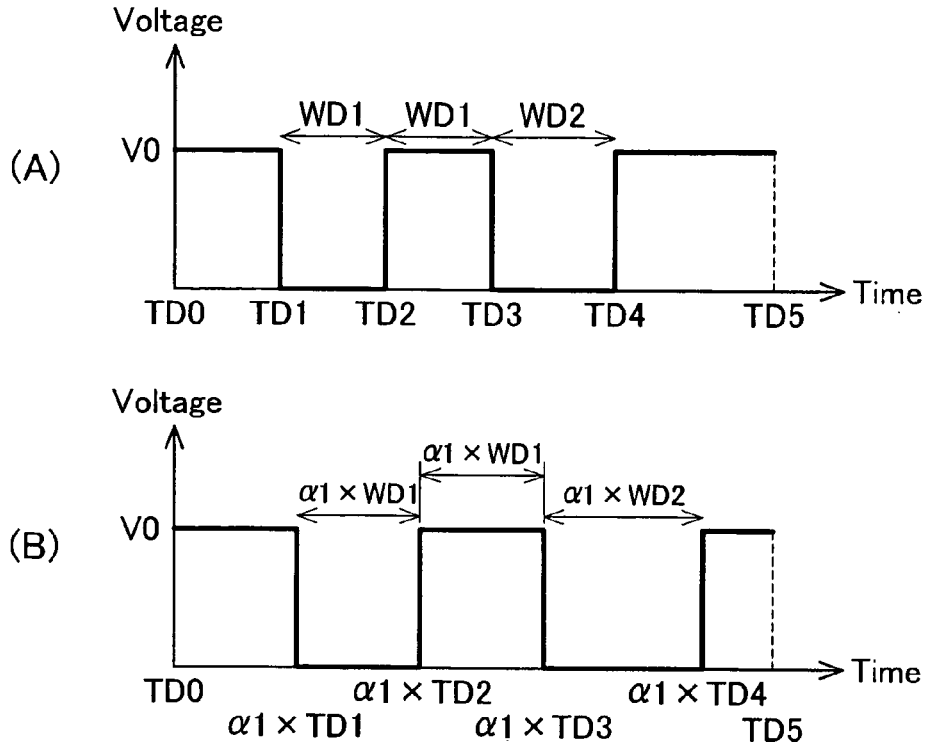
FIG. 11(A) shows base pulse signals for double discharging.
FIG. 11(B) shows pulse signals for double discharging.

FIG. 11(A) shows waveforms of the base pulse signals for double discharging. The pulse width of the first base pulse is WD1. The pulse width of the second base pulse is WD2. A period between the first base pulse and the second base pulse is set to be WD1.

FIG. 11(B) shows pulse signals obtained by multiplying the base pulse signals of FIG. 11(A) by the coefficient $\alpha$1. The pulse width of the first pulse signal is $\alpha$1×WD1, and the pulse width of the second pulse signal is $\alpha$1×WD2. A period between the first pulse signal and the second pulse signal is $\alpha$1×WD1. The ending time of the printing period is fixed at TD5. Moreover, TD5 is identical with TS3 (see FIG. 10).

Figure 12:
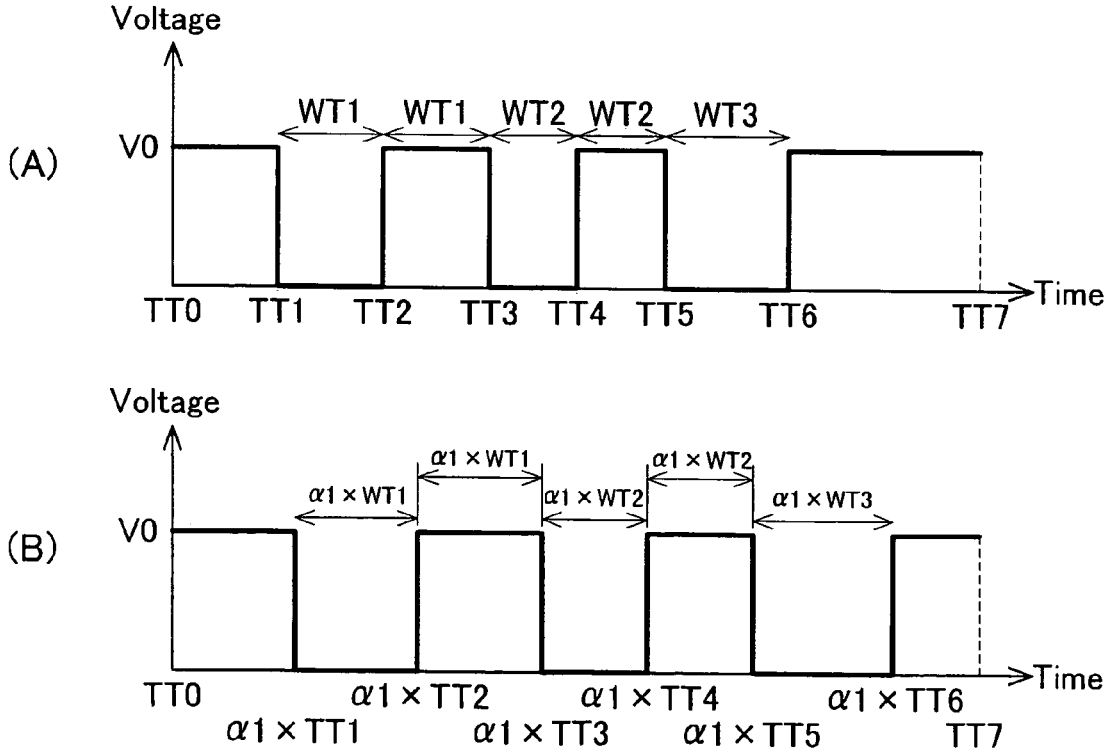
FIG. 12(A) shows base pulse signals for triple discharging.
FIG. 12(B) shows pulse signals for triple discharging.

FIG. 12(A) shows waveforms of the base pulse signals for triple discharging. The pulse width of the first base pulse is WT1. The pulse width of the second base pulse is WT2. The pulse width of the third base pulse is WT3. A period between the first base pulse and the second base pulse is set to be WT1. A period between the second base pulse and the third base pulse is set to be WT2.

FIG. 12(B) shows pulse signals obtained by multiplying the base pulse signals of FIG. 12(A) by the coefficient $\alpha$1. The pulse width of the first pulse signal is $\alpha$1×WT1, and the pulse width of the second pulse signal is $\alpha$1×WT2. The pulse width of the third pulse signal is $\alpha$1×WT3. A period between the first pulse signal and the second pulse signal is $\alpha$1×WT1. A period between the second pulse signal and the third pulse signal is $\alpha$1×WT2. The ending time of the printing period is fixed at TT7. Moreover, TT7 is identical with TS3 (see FIG. 10). That is, TT7, TS3 and TD5 are identical.

The printer 1 of the present embodiment determines the pulse signals to be applied to the piezoelectric elements 20 based on the base pulse signals and each coefficient that has been set for each actuator unit 21. For example, a pulse signal that was obtained by multiplying the base pulse signal by the coefficient $\alpha$1 is applied to the piezoelectric elements 20 of the actuator unit 21 that corresponds to the coefficient $\alpha$1. As another example, a pulse signal that was obtained by multiplying the base pulse signal by the coefficient $\alpha$2 is applied to the piezoelectric elements 20 of the actuator unit 21 that corresponds to the coefficient $\alpha$2.

The same coefficient can be utilized for the same actuator unit 21 even when the pulse signals that are being applied are for single discharging, double discharging, and for triple discharging.

Figure 13:
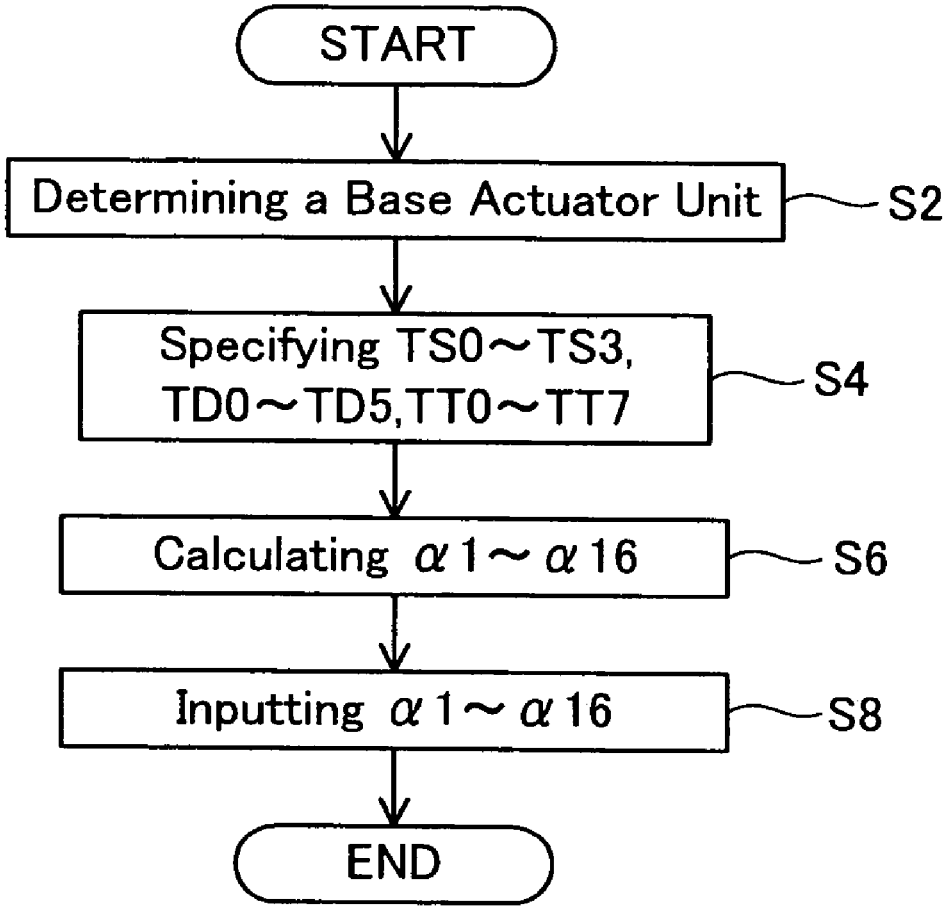
FIG. 13 shows a flowchart of a process of manufacturing the ink jet printer.

Next, a method of manufacturing the printer 1 will be described. That is, the processes will be described for determining the base pulse signals and the coefficients. FIG. 13 shows a flowchart of the method of manufacturing the printer 1.

As shown in FIG. 13, a base actuator unit is first determined (S2). This process is executed as follows.

(S2-1) An ideal value AL (Acoustic length) for a pulse width for single discharging is obtained. This value allows maximum discharge speed of the ink droplet in the case of single discharging. AL is a time taken for a pressure wave—this being generated by moving from the state in FIG. 6(A) to the state in FIG. 6(B)—to be proceeded from the nozzle 8 to the opening of the aperture 12 (the left edge of the aperture 12 in FIG. 6(A). AL can be calculated from the structure of the ink jet head.

(S2-2) Next, a pulse signal (for single discharging) having a predetermined pulse width (for example, W1) is applied to a plurality of piezoelectric elements of one actuator unit. The discharge speed of ink droplets discharged from the nozzles is measured. The average value of the measured discharge speed is calculated.

(S2-3) The process of (S2-2) is executed with varying pulse widths. The average value of the ink droplet discharge speed for each pulse width is calculated.

Figure 14:
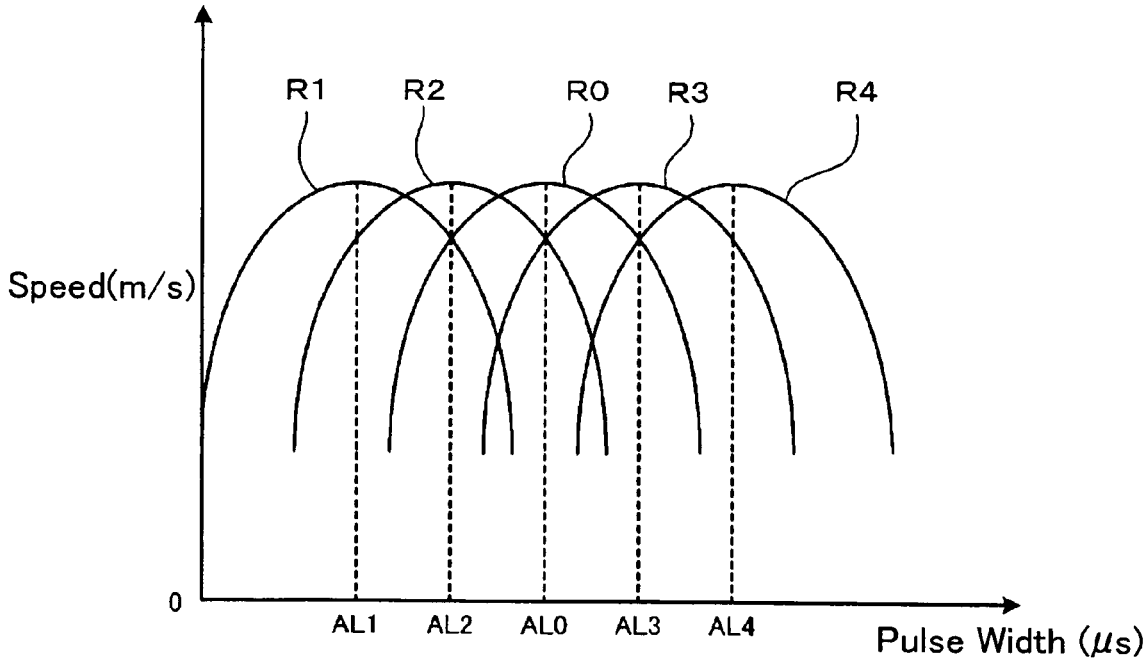
FIG. 14 shows a graph with pulse width on the horizontal axis and ink droplet discharge speed on the vertical axis.

(S2-4) The results obtained in (S2-2) and (S2-3) are plotted in a graph in which pulse width is on the horizontal axis and discharge speed is on the vertical axis. Then a curved line is drawn passing through the points that have been plotted. The curved line RO in FIG. 14 is an example of a curved line obtained by this process. When the curved line is drawn, the pulse width AL0 in which the maximum discharge speed can be obtained is specified.

(S2-5) The processes of (S2-2) to (S2-4) are executed for a plurality of actuator units (for example, for ten actuator units). In this manner, for example ten pulse widths AL0 are specified.

(S2-6) An actuator unit is specified from the actuator units for which the processes of (S2-2) to (S2-5) have been executed: this specified actuator has the pulse width AL0 which is the closest to the ideal value AL obtained in (S2-1). The specified actuator unit becomes the base actuator unit.

When the base actuator unit has been specified in S2 of FIG. 13, the base pulse signals are specified based on this actuator unit (S4). That is, TS0 to TS3, TD0 to TD5, and TT0 to TT7 of FIG. 8 are determined. This process is executed as follows.

(S4-1) First, the base pulse signal for single discharging is specified. Specifically, TS0 to TS3 are specified. TS0 is zero. TS1 is a value that is half of AL0 of the base actuator unit. TS2 is a value where the pulse width AL0 has been added to TS1. The time AL0 between TS1 and TS2 is the pulse width. This pulse width AL0 becomes the base pulse width WS of FIG. 10(A). A predetermined fixed value is utilized as TS3.

(S4-2) The base pulse signals for double discharging are specified. Specifically, TD0 to TD5 of FIG. 8 are specified. This process is executed as follows.

(S4-2-1) Pulse signals for double discharging are applied to the plurality of piezoelectric elements of the base actuator unit. The pulse signals for double discharging utilize a predetermined pulse width (for example, W1') as the pulse width for the first pulse signal. A fixed value (for example, WS) is utilized as the pulse width for the second pulse signal. The time between the first pulse signal and the second pulse signal utilizes the pulse width (for example, W1') of the first pulse signal. The average value of the discharge speed of the ink droplets discharged from the plurality of nozzles is calculated. Here, the average value of the discharge speed of the ink droplets is calculated after the two ink droplets have merged.

(S4-2-2) The process of (S4-2-1) is executed with varying pulse widths for the first pulse signal. The average value of the ink droplet discharge speed for each of the pulse widths is calculated.

(S4-2-3) The results obtained in (S4-2-1) and (S4-2-2) are plotted in a graph in which pulse width is on the horizontal axis and discharge speed is on the vertical axis. Then a curved line is drawn passing through the points that have been plotted. When the curved line is drawn, the pulse width WD1 in which the maximum discharge speed can be obtained is specified.

(S4-2-4) The process of (S4-2-1) is executed utilizing the fixed value WD1 (the pulse width that was specified in (S4-2-3)) as the pulse width of the first pulse signal, and utilizing a predetermined value as the pulse width of the second pulse signal.

(S4-2-5) The process of (S4-2-4) is executed with varying pulse widths for the second pulse signal. The average value of the ink droplet discharge speed for each of the pulse widths is calculated.

(S4-2-6) The results obtained in (S4-2-4) and (S4-2-5) are plotted in a graph in which pulse width is on the horizontal axis and discharge speed is on the vertical axis. Then a curved line is drawn passing through the points that have been plotted. When the curved line is drawn, the pulse width WD2 in which the maximum discharge speed can be obtained is specified.

(S4-2-7) TD0 is zero. TD1 is a value that is half of WD1 obtained in (S4-2-3). TD2 is a value where WD1 has been added to TD1. The time between TD1 and TD2 is the pulse width WD0 (see FIG. 11(A)). TD3 is a value where the pulse width WD1 has been added to TD2. TD4 is a value obtained by adding TD3 and WD2 that was obtained in (S4-2-6). The time between TD3 and TD4 is the pulse width WD2 (see FIG. 11(A)). A predetermined fixed value (a value identical with TS3) is utilized as TD5.

(S4-3) The base pulse signals for triple discharging are specified. That is, TT0 to TT7 of FIG. 8 are specified. This process is executed as follows.

(S4-3-1) Pulse signals for triple discharging are applied to the plurality of piezoelectric elements of the base actuator unit. The pulse signals for triple discharging utilize a predetermined pulse width (for example, W1") as the pulse width for a first pulse signal. A fixed value (for example, WS) is utilized as the pulse width for a second pulse signal. The time between the first pulse signal and the second pulse signal utilizes the pulse width (for example, W1") of the first pulse signal. A fixed value (for example, WS) is utilized as the pulse width for a third pulse signal. The time between the second pulse signal and the third pulse signal is utilized as the pulse width (for example, WS) of the second pulse signal. The average value of the discharge speed of the ink droplets discharged from the plurality of nozzles is calculated. Here, the average discharge speed of the ink droplets is calculated after the three ink droplets have merged.

(S4-3-2) The process of (S4-3-1) is executed with varying pulse widths for the first pulse signal. The average value of the ink droplet discharge speed for each of the pulse widths is calculated.

(S4-3-3) The results obtained in (S4-3-1) and (S4-3-2) are plotted in a graph in which pulse width is on the horizontal axis and discharge speed is on the vertical axis. Then a curved line is drawn passing through the points that have been plotted. When the curved line is drawn, the pulse width WT1 in which the maximum discharge speed can be obtained is specified.

(S4-3-4) The process of (S4-3-1) is executed utilizing the fixed value WT1 (the pulse width that was specified in (S4-3-3)) as the pulse width of the first pulse signal, utilizing a predetermined value as the pulse width of the second pulse signal, and utilizing the fixed value (for example, WS) as the pulse width of the third pulse signal.

(S4-3-5) The process of (S4-3-4) is executed with varying pulse widths for the second pulse signal. The average value of the ink droplet discharge speed for each of the pulse widths is calculated.

(S4-3-6) The results obtained in (S4-3-4) and (S4-3-5) are plotted in a graph in which pulse width is on the horizontal axis and discharge speed is on the vertical axis. Then a curved line is drawn passing through the points that have been plotted. When the curved line is drawn, the pulse width WT2 in which the maximum discharge speed can be obtained is specified.

(S4-3-7) The process of (S4-3-1) is executed utilizing the fixed value WT1 (the pulse width that was specified in (S4-3-3)) as the pulse width of the first pulse signal, utilizing the fixed value WT2 (the pulse width that was specified in (S4-3-6)) as the pulse width of the second pulse signal, and utilizing a predetermined value as the pulse width of the third pulse signal.

(S4-3-8) The process of (S4-3-7) is executed with varying pulse widths for the third pulse signal. The average value of the ink droplet discharge speed for each of the pulse widths is calculated.

(S4-3-9) The results obtained in (S4-3-7) and (S4-3-8) are plotted in a graph in which pulse width is on the horizontal axis and discharge speed is on the vertical axis. Then a curved line is drawn passing through the points that have been plotted. When the curved line is drawn, the pulse width WT3 in which the maximum discharge speed can be obtained is specified.

(S4-3-10) TT0 is zero. TT1 is a value that is half of WT1 obtained in (S4-3-3). TT2 is a value where WT1 has been added to TT1. The time between TT1 and TT2 is the pulse width WT1 (see FIG. 12 (A)). TT3 is a value where the pulse width WT1 has been added to TT2. TT4 is a value obtained by adding TT3 and WT2 that was obtained in (S4-3-6). The time between TT3 and TT4 is the pulse width WT2 (see FIG. 12 (A)). TT5 is a value where WT2 has been added to TT4. TT6 is a value where the pulse width WT3 obtained in (S4-3-9) has been added to TT5. The time between TT5 and TT6 is the pulse width WT3 (see FIG. 12 (A)). A predetermined fixed value (a value identical with TS3 and TD5) is utilized as TT7.

The ink jet printer is prepared after executing the processes of S4 of FIG. 13. This ink jet printer contains programs for creating the pulse signals by multiplying the base pulse signals obtained in the processes of S4 by the coefficients. For example, as described above, the ink jet printer 1 that has the four ink jet heads 2*a* to 2*d* is manufactured. The specific coefficients are not stored in the coefficient storage 204 of FIG. 7 at this step. To deal with this, the processes of S6 of FIG. 13 are executed. In S6, the coefficients ($\alpha$1to $\alpha$16) of the printer 1 are determined. This process is executed as follows.

(S6-1) The coefficient of one actuator unit is determined. Here, the determination of the coefficient $\alpha$1 of the actuator unit 21*a* of the ink jet head 2*a* will be described as an example.

(S6-1-1) $\alpha$1 is input as a predetermined value. $\alpha$1 can be input utilizing, for example, the operation panel 250 (see FIG. 1, etc). Then, a pulse signal (a pulse signal for single discharging) is applied to the piezoelectric elements 20 of the actuator unit 21*a* of the ink jet head 2*a*. The pulse signal that is applied has a pulse width of $\alpha 1 \times$WS. The discharge speed of the ink droplets discharged from the nozzles is measured. The average value of the measured discharge speed is calculated.

(S6-1-2) The process of (S6-1-1) is executed with varying values for the coefficient $\alpha$1. The average value of the ink droplet discharge speed for each of the coefficients $\alpha$1 is calculated.

(S6-1-3) The results obtained in (S6-1-1) and (S6-1-2) are plotted in a graph in which pulse width is on the horizontal axis and discharge speed is on the vertical axis. Then a curved line is drawn passing through the points that have been plotted. The curved line R1 in FIG. 14 is an example of this curved line. When the curved line is drawn, the pulse width AL1 in which the maximum discharge speed can be obtained is specified.

(S6-1-4) The pulse width AL1 obtained in (S6-1-3) is divided by the base pulse width WS of the pulse signal for single discharging, thus obtaining $\alpha$1.

(S6-2) The same process (S6-1) is executed for the other actuator units. For example, the process is executed for the actuator unit 21*b* of the ink jet head 2*a*. In this case, the graph of R2 of FIG. 14 is obtained. The pulse width AL2 specified from the graph R2 is divided by the base pulse width WS, thus obtaining $\alpha$2.

As another example, the process is executed for the actuator unit 21*c* of the ink jet head 2*a*. In this case, the graph of R3 of FIG. 14 is obtained. The pulse width AL3 specified from the graph R3 is divided by the base pulse width WS, thus obtaining $\alpha$3.

As another example, the process is executed for the actuator unit 21*d* of the ink jet head 2*a*. In this case, the graph of R4 of FIG. 14 is obtained. The pulse width AL4 specified from the graph R4 is divided by the base pulse width WS, thus obtaining $\alpha$4.

The same process is executed for the other ink jet heads 2*b* to 2*d*, thereby obtaining $\alpha$5 to $\alpha$16.

When the process of S6 of FIG. 13 has been completed, the process proceeds to S8. In S8, $\alpha$1 to $\alpha$16 that were calculated in S6 are input to the inkjet printer 1. $\alpha$1 to $\alpha$16 can be input utilizing the operation panel 250 (see FIG. 1, etc.). The coefficients that have been input are stored in the coefficient storage 204 of FIG. 7. The ink jet printer 1 is thus completed.

According to the present embodiment, the pulse width in which the maximum discharge speed of the ink droplets can be obtained during single discharging is obtained in (S6-1-3). Then this pulse width is divided by the base pulse width WS, thereby obtaining the coefficient. The printer 1 multiplies the coefficient that has been obtained by the base pulse width WS, thereby creating the pulse signal for single discharging. That is, the pulse width in which the maximum discharge speed of the ink droplets can be obtained is utilized for single discharging. When the pulse width has been determined utilizing the coefficient that has been obtained, satisfactory printing results can be achieved.

Further, the coefficient that has been obtained is also utilized for creating the pulse signals for double discharging and the pulse signals for triple discharging. That is, when the coefficient that was determined based on single discharging is multiplied by the base pulse signals for double discharging, the pulse signals for double discharging are created. Further, when the coefficient that was determined based on single discharging is multiplied by the base pulse signals for triple discharging, the pulse signals for triple discharging are created. The present inventors realized from their research that, if satisfactory printing results can be achieved by executing single discharging utilizing the base pulse width and the coefficient that has been obtained, satisfactory printing results can also be achieved by executing double discharging and triple discharging utilizing that coefficient.

In the present embodiment, it is possible to create the pulse signal for single discharging, the pulse signals for double discharging, and the pulse signals for triple discharging merely by inputting one coefficient for one actuator unit. A plurality of pulse signals that allow satisfactory printing results to be achieved can be created merely by inputting a comparatively small amount of data.

SECOND EMBODIMENT

Figure 15:
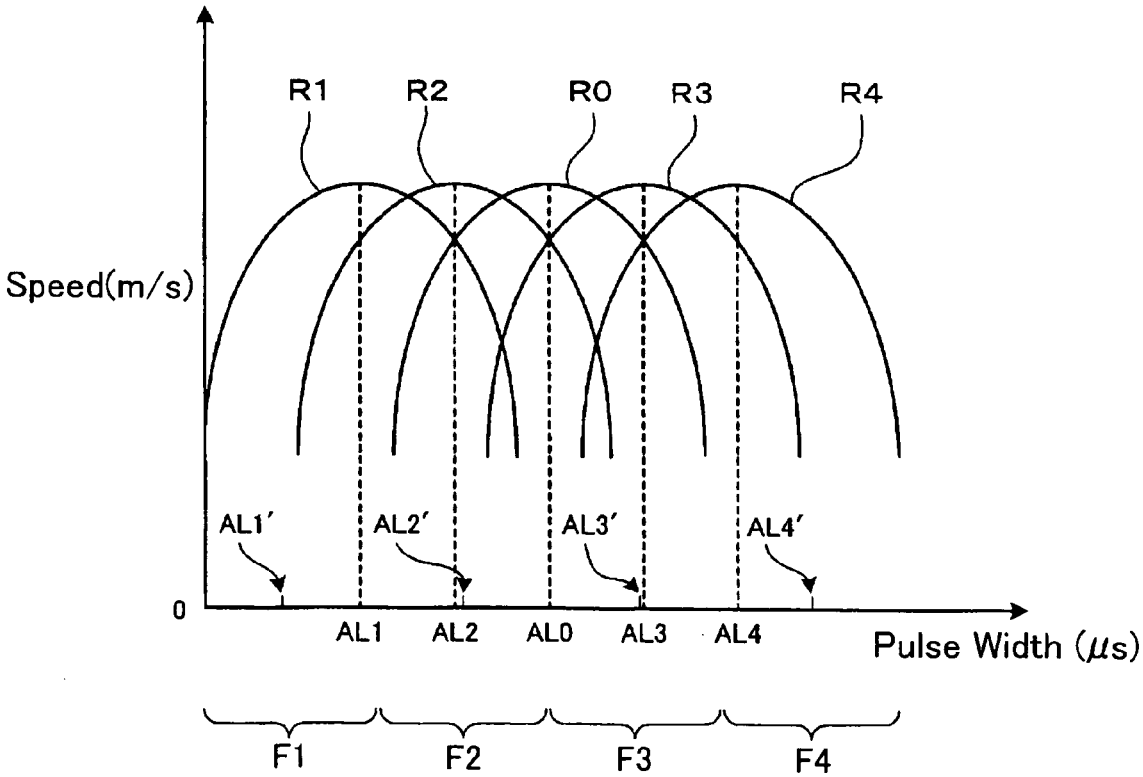
FIG. 15 shows a graph with pulse width on the horizontal axis and ink droplet discharge speed on the vertical axis.

Only parts differing from the first embodiment will be described. In the present embodiment, the process of S6 of FIG. 13 differs from the first embodiment. In particular, the processes of (S6-1-3) and (S6-1-4) differ from the first embodiment. In (S6-1-3), if for example the curved line R1 of FIG. 15 is obtained, the pulse width AL1 in which the maximum discharge speed can be obtained is specified. In the present embodiment, the range of the discharge speed is set to be F1 to F4. Then it is specified whether the pulse width AL1 that has been specified is included in any of these ranges (F1 in this example). A representative value AL1'of that range F1 is specified. The representative value AL1'is an intermediate value of the range F1.

If the pulse width in which the maximum discharge speed can be obtained is included in the range F2 (in the case of the graph R2 of FIG. 15), a representative value AL2' of the range F2 is specified. The representative value AL2' is an intermediate value of the range F2. If the pulse width in which the maximum discharge speed can be obtained is included in the range F3 (in the case of the graph R3 of FIG. 15), a representative value AL3' of the range F3 is specified. The representative value AL3' is an intermediate value of the range F3. If the pulse width in which the maximum discharge speed can be obtained is included in the range F4 (in the case of the graph R4 of FIG. 15), a representative value AL4' of the range F4 is specified. The representative value AL4' is an intermediate value of the range F4.

In (S6-1-4), the representative value (for example, AL1') obtained in (S6-1-3) is divided by the base pulse width WS for single discharging. The coefficient (for example, α1) can thus be obtained.

The coefficients for the other actuator units can be obtained by executing the same process.

THIRD EMBODIMENT

Only parts differing from the first embodiment will be described. In the present embodiment, the coefficient storage 204 of FIG. 7 stores coefficients for each of the piezoelectric elements. For example, if one actuator unit 21 has 1000 piezoelectric elements 20, the printer requires 16000 coefficients.

The print signal creating portion 206 determines the pulse signals to be applied to each of the piezoelectric elements 20 by multiplying the base pulse signal by the coefficient of that piezoelectric element 20. For example, if the coefficient of a piezoelectric element 20A is αA, the pulse signal of the piezoelectric element 20A is determined by multiplying the base pulse signal by αA. Further, if the coefficient of a piezoelectric element 20B is αB, the pulse signal of the piezoelectric element 20B is determined by multiplying the base pulse signal by αB.

In the case of the present embodiment, the process of S6 of FIG. 13 differs from the first embodiment. In S6, the coefficient of each of the piezoelectric elements is determined.

(S6-1') Here, the case in which the coefficient of the piezoelectric element 20A is determined will be given as an example.

(S6-1'-1) A predetermined value is input as the coefficient αA of the piezoelectric element 20A. A pulse signal (a pulse signal for single discharging) is applied to the piezoelectric element 20A. The pulse signal that is applied has a pulse width of αA×WS in which αA is multiplied by the base pulse width WS. The discharge speed of the ink droplet is measured.

(S6-1'-2) The process of (S6-1'-1) is executed with varying values for the coefficient αA. The discharge speed of the ink droplets for each of the coefficients αA is calculated.

(S6-1'-3) The results obtained in (S6-1'-1) and (S6-1'-2) are plotted in a graph in which pulse width is on the horizontal axis and discharge speed is on the vertical axis. Then a curved line is drawn passing through the points that have been plotted. When the curved line is drawn, the pulse width ALA in which the maximum discharge speed can be obtained is specified.

(S6-1'-4) The pulse width ALA obtained in (S6-1'-3) is divided by the base pulse width WS of the pulse signal for single discharging, thus obtaining αA.

(S6-2') The same process of (S6-1') is executed for the other piezoelectric elements 20. The coefficient of each of the piezoelectric elements 20 can thus be obtained.

The coefficients that have been obtained are input to the printer 1 in S8 of FIG. 13.

FOURTH EMBODIMENT

Only parts differing from the first embodiment will be described. In the present embodiment, the coefficient storage 204 of FIG. 7 stores coefficients of each of the ink jet heads. That is, a coefficient of the ink jet head 2*a*, a coefficient of the ink jet head 2*b*, a coefficient of the ink jet head 2*c*, and a coefficient of the ink jet head 2*d* are stored. Only four coefficients are stored in the coefficient storage 204.

The print signal creating portion 206 determines the pulse signals to be applied to each of the piezoelectric elements 20 by multiplying the base pulse signal by the coefficient of the ink jet head (for example, 2*a*) that has the piezoelectric elements 20.

In the case of the present embodiment, the process of S6 of FIG. 13 differs from the first embodiment. In S6, the coefficients of the four ink jet heads 2*a* to 2*d* are determined.

(S6-1") The coefficient of one ink jet head is determined. Here, the case in which the coefficient αA of the ink jet head 2*a* is determined will be given as an example.

(S6-1"-1) A predetermined value is input as the coefficient αA. A pulse signal (a pulse signal for single discharging) is applied to some of the piezoelectric elements 20A included in the ink jet head 2*a*. It is preferred that the piezoelectric elements 20 to which the pulse signal is applied are selected from each of the actuator units 21*a* to 21*d*. For example, one piezoelectric element 20 can be chosen from each of the actuator units 21*a* to 21*d*. The pulse signal that is applied has a pulse width of αA×WS in which αA is multiplied by the base pulse width WS. The discharge speed of the ink droplet discharged from each nozzle is measured. The average value of the measured discharge speed is calculated.

(S6-1"-2) The process of (S6-1"-1) is executed with varying values for the coefficient αA. The discharge speed of the ink droplets for each of the coefficients αA is calculated.

(S6-1"-3) The results obtained in (S6-1"-1) and (S6-1"-2) are plotted in a graph in which pulse width is on the horizontal axis and discharge speed is on the vertical axis. Then a curved line is drawn passing through the points that have been plotted. When the curved line is drawn, the pulse width ALA in which the maximum discharge speed can be obtained is specified.

(S6-1"-4) The pulse width ALA obtained in (S6-1"-3) is divided by the base pulse width WS of the pulse signal for single discharging, thus obtaining αA.

(S6-2") The same process of (S6-1") is executed for the other ink jet heads 2*b*, etc. The coefficients of the ink jet heads 2*a* to 2*d* can thus be obtained.

The coefficients that have been obtained are input to the printer 1 in S8 of FIG. 13.

Some representative modifications to the aforementioned embodiments are listed here.

(1) The aforementioned embodiments can be applied to a serial type printer in which the ink jet heads move with a printer main body.

(2) The operation panel 250 (see FIG. 7) need not be utilized to input the coefficients. For example, the coefficients may be input utilizing the PC 252. The coefficients input utilizing the PC 252 are input to the inputting portion 210 of FIG. 7. The coefficients that have been input are stored in the coefficient storage 204.

(3) The process of S8 of FIG. 13 may be executed by the manufacturer of the printer 1, or by the user of the printer 1. If executed by the user of the printer 1, the manufacturer of the printer 1 executes a process of informing the user of the results (i.e. the coefficients) of the process of S6.

(4) In the base pulse signal for double discharging, the pulse width WD1 of the first pulse signal and the pulse width WD2 of the second pulse signal may be identical.

In this case, (S4-2) of the first embodiment may be modified as follows.

(S4-2-1) Pulse signals for double discharging are applied to the plurality of piezoelectric elements of the base actuator unit. The pulse signals for double discharging utilize a predetermined pulse width (for example, W1') as the pulse width for the first pulse signal. The pulse width for the second pulse signal is the same as the pulse width (for example, W1') for the first pulse signal. The time between the first pulse signal and the second pulse signal utilizes the pulse width (for example, W1') of the first pulse signal. The average value of the discharge speed of the ink droplets discharged from the plurality of nozzles is calculated.

(S4-2-2) The process of (S4-2-1) is executed with varying pulse widths. The pulse width for the first pulse signal and the pulse width for the second pulse signal are the same. The average value of the discharge speed of the ink droplets for each of the pulse widths is calculated.

(S4-2-3) The results obtained in (S4-2-1) and (S4-2-2) are plotted in a graph in which pulse width is on the horizontal axis and discharge speed is on the vertical axis. Then a curved line is drawn passing through the points that have been plotted. When the curved line is drawn, the pulse width WD1 in which the maximum discharge speed can be obtained is specified. The same value as in the pulse width WD1 is utilized in the pulse width WD2. The processes of (S4-2-4) to (S4-2-6) are not executed. The process of (S4-2-7) is the same as in the first embodiment.

(5) In the base pulse signal for triple discharging, the pulse width WT1 of the first pulse signal, the pulse width WT2 of the second pulse signal, and the pulse width WT3 of the third pulse signal may be identical.

In this case, (S4-3) of the first embodiment can be modified as follows.

(S4-3-1) Pulse signals for triple discharging are applied to the plurality of piezoelectric elements of the base actuator unit. The pulse signals for triple discharging utilize a predetermined pulse width (for example, W1") as the pulse width for the first pulse signal. The pulse widths for the second pulse signal and the third pulse signal use the same value as the pulse width (for example, W1") for the first pulse signal. The time between the first pulse signal and the second pulse signal utilizes the pulse width (for example, W1") of the first pulse signal. The time between the second pulse signal and the third pulse signal is utilized as the pulse width of the second pulse signal (i.e. the pulse width of the first pulse signal). The average value of the discharge speed of the ink droplets discharged from the plurality of nozzles is calculated.

(S4-3-2) The process of (S4-3-1) is executed with varying pulse widths. The pulse widths for the first pulse signal, the second pulse signal and the third pulse signal are the same. The average value of the discharge speed of the ink droplets for each of the pulse widths is calculated.

(S4-3-3) The results obtained in (S4-3-1) and (S4-3-2) are plotted in a graph in which pulse width is on the horizontal axis and discharge speed is on the vertical axis. Then a curved line is drawn passing through the points that have been plotted. When the curved line is drawn, the pulse width WT1 in which the maximum discharge speed can be obtained is specified. The same value as in the pulse width WT1 is utilized in the pulse width WT2 and the pulse width WT3. The processes of (S4-3-4) to (S4-3-9) are not executed. The process of (S4-3-10) is the same as in the first embodiment.

(6) At least two of the six base pulse widths WS, WD1, WD2, WT1, WT2, WT3 of the present embodiments may be identical pulse widths. For example, WS, WD1, and WT1 may be identical pulse widths.

(7) In the aforementioned embodiments, the print signal creating portion 206 (see FIG. 7) multiplies the base pulse signals and the coefficients when the print signals are created. However, the base pulse signals and the coefficients may be multiplied when the coefficients are input. In this case, various kinds of pulse signals can be obtained before the print signals are created. If this is done, calculation is not required at the time of printing.

What is claimed is:

1. An ink jet printer, comprising:

an ink jet head comprising a nozzle that discharges an ink droplet toward a print medium and an actuator that makes the nozzle discharge the ink droplet when a pulse signal is applied to the actuator;

an applying device configured to apply at least two kinds of pulse signals to the actuator, wherein the pulse width of each kind of pulse signal mutually differs;

a first storage that stores at least two kinds of base pulse widths, wherein each kind of base pulse width corresponds with a different kind of pulse signal, and each kind of base pulse width mutually differs;

an inputting device that inputs a fixed predetermined value; and a second storage that stores the fixed predetermined value input by the inputting device, wherein the applying device determines a pulse width of each kind of pulse signal by multiplying the corresponding base pulse width stored in the first storage by the fixed predetermined value stored in the second storage, the applying device is configured to apply a first pulse signal to the actuator, the applying device is configured to apply a second pulse signal to the actuator, the first storage stores a first base pulse width corresponding to the first pulse signal, and a second base pulse width corresponding to the second pulse signal, the applying device determines a pulse width of the first pulse signal by multiplying the first base pulse width stored in the first storage by the fixed predetermined value stored in the second storage, the applying device determines a pulse width of the second pulse signal by multiplying the second base pulse width stored in the first storage by the fixed predetermined value stored in the second storage, and the fixed predetermined value is determined by dividing a pulse width of a pulse signal which is configured to obtain the largest ink droplet discharging speed by the first base pulse width.

2. The ink jet printer as in claim 1, wherein the applying device is configured to apply one first pulse signal to the actuator within a predetermined period, and the actuator makes the nozzle discharge one ink droplet to form one dot on the print medium when the first pulse signal is applied to the actuator within the predetermined period.

3. A method of determining the fixed predetermined value input by the inputting device of the claim 2, the method comprising:

a step of specifying a pulse width of a pulse signal which is configured to obtain the largest ink droplet discharging speed when the pulse signal is applied to the actuator within the predetermined period, and a step of dividing the pulse signal specified in the above step by the base pulse width corresponding with the first pulse signal.

4. The ink jet printer as in claim 1, wherein the applying device is configured to apply one second pulse signal and one third pulse signal to the actuator within a predetermined period, and the actuator makes the nozzle discharge two ink droplets to form one dot on the print medium when the second pulse signal and the third pulse signal are applied to the actuator within the predetermined period.

5. The ink jet printer as in claim 4, wherein the first storage stores a first base period between the second pulse signal and the third pulse signal, and the applying device determines a period between the second pulse signal and the third pulse signal by multiplying the first base period stored in the first storage by the fixed predetermined value stored in the second storage.

6. The ink jet printer as in claim 1, wherein the applying device is configured to apply one fourth pulse signal, one fifth pulse signal, and one sixth pulse signal to the actuator within a predetermined period, and the actuator makes the nozzle discharge three ink droplets to form one dot on the print medium when the fourth pulse signal, the fifth pulse signal, and the sixth pulse signal are applied to the actuator within the predetermined period.

7. The ink jet printer as in claim 6, wherein the first storage stores a second base period between the fourth pulse signal and the fifth pulse signal, and a third base period between the fifth pulse signal and the sixth pulse signal, and the applying device determines a period between the fourth pulse signal and the fifth pulse signal by multiplying the second base period stored in the first storage by the fixed predetermined value stored in the second storage, and determines a period between the fifth pulse signal and the sixth pulse signal by multiplying the third base period stored in the first storage by the fixed predetermined value stored in the second storage.

8. The ink jet printer as in claim 1, wherein the ink jet head further comprises a pressure chamber communicating with the nozzle, the actuator is a piezoelectric element facing the pressure chamber.

9. The ink jet printer as in claim 8, wherein the ink jet head comprises a plurality of units, each unit comprises the nozzle, the pressure chamber, and the piezoelectric element, the piezoelectric elements are divided into a plurality of element groups, each element group comprises a common electrode, a plurality of individual electrodes, and a piezoelectric layer disposed between the common electrode and the individual electrodes, an inputting device inputs the fixed predetermined value for each element group, the second storage stores a plurality of combinations of the fixed predetermined value and the element group, and wherein the applying device determines the pulse width of each kind of pulse signal for each element group by multiplying the corresponding base pulse width stored in the first storage by the fixed predetermined value combined with the element group in the second storage.

10. The ink jet printer as in claim 8, wherein the ink jet head comprises a plurality of units, each unit comprises the nozzle, the pressure chamber, and the piezoelectric element, an inputting device inputs the fixed predetermined value for each piezoelectric element, the second storage stores a plurality of combinations of the fixed predetermined value and the piezoelectric element, and wherein the applying device determines the pulse width of each kind of pulse signal for each piezoelectric element by multiplying the corresponding base pulse width stored in the first storage by the fixed predetermined value combined with the piezoelectric element in the second storage.

11. The ink jet printer as in claim 1, wherein the ink jet printer comprises a plurality of ink jet heads, an inputting device inputs the fixed predetermined value for each ink jet head, the second storage stores a plurality of combinations of the fixed predetermined value and the ink jet head, and wherein the applying device determines the pulse width of each kind of pulse signal for each ink jet head by multiplying the corresponding base pulse width stored in the first storage by the fixed predetermined value combined with the ink jet head in the second storage.

12. The ink jet printer as in claim 1, wherein the pulse width of each kind of pulse signal determined by the applying device is a pulse width for making the nozzle discharge the ink droplet.

13. An ink jet printer, comprising:

an ink jet head comprising a nozzle that discharges an ink droplet toward a print medium and an actuator that makes the nozzle discharge the ink droplet when a pulse signal is applied to the actuator;

an applying device configured to apply at least two kinds of pulse signals to the actuator, wherein the pulse width of each kind of pulse signal mutually differs;

a first storage that stores at least two kinds of base pulse widths, wherein each kind of base pulse width corresponds with a different kind of pulse signal, and each kind of base pulse width mutually differs;

an inputting device that inputs a fixed predetermined value; and a second storage that stores the fixed predetermined value input by the inputting device, wherein the applying device determines a pulse width of each kind of pulse signal by multiplying the corresponding base pulse width stored in the first storage by the fixed predetermined value stored in the second storage;

the applying device is configured to apply one second pulse signal and one third pulse signal to the actuator within a predetermined period, and the actuator makes the nozzle discharge two ink droplets to form one dot on the print medium when the second pulse signal and the third pulse signal are applied to the actuator within the predetermined period, the first storage stores a first base period between the second pulse signal and the third pulse signal, and the applying device determines a period between the second pulse signal and the third pulse signal by multiplying the first base period stored in the first storage by the fixed predetermined value stored in the second storage.

14. An ink jet printer, comprising:

an ink jet head comprising a nozzle that discharges an ink droplet toward a print medium and an actuator that makes the nozzle discharge the ink droplet when a pulse signal is applied to the actuator;

an applying device configured to apply at least two kinds of pulse signals to the actuator, wherein the pulse width of each kind of pulse signal mutually differs;

a first storage that stores at least two kinds of base pulse widths, wherein each kind of base pulse width corresponds with a different kind of pulse signal, and each kind of base pulse width mutually differs;

an inputting device that inputs a fixed predetermined value; and a second storage that stores the fixed predetermined value input by the inputting device, wherein the applying device determines a pulse width of each kind of pulse signal by multiplying the corresponding base pulse width stored in the first storage by the fixed predetermined value stored in the second storage, the applying device is configured to apply one fourth pulse signal, one fifth pulse signal, and one sixth pulse signal to the actuator within a predetermined period, the actuator makes the nozzle discharge three ink droplets to form one dot on the print medium when the fourth pulse signal, the fifth pulse signal, and the sixth pulse signal are applied to the actuator within the predetermined period, the first storage stores a second base period between the fourth pulse signal and the fifth pulse signal, and a third base period between the fifth pulse signal and the sixth pulse signal, and the applying device determines a period between the fourth pulse signal and the fifth pulse signal by multiplying the second base period stored in the first storage by the fixed predetermined value stored in the second storage, and determines a period between the fifth pulse signal and the sixth pulse signal by multiplying the third base period stored in the first storage by the fixed predetermined value stored in the second storage.

* * * * *